US006616480B2

(12) United States Patent
Kameyama

(10) Patent No.: US 6,616,480 B2
(45) Date of Patent: Sep. 9, 2003

(54) SEALING STRUCTURE OF ACCESSORY MODULE

(75) Inventor: Isao Kameyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/057,985

(22) Filed: Jan. 29, 2002

(65) Prior Publication Data

US 2002/0101041 A1 Aug. 1, 2002

(30) Foreign Application Priority Data

Jan. 30, 2001 (JP) ..... P2001-021804

(51) Int. Cl.[7] ..... H01R 13/40

(52) U.S. Cl. ..... 439/587; 439/76.1; 439/76.2; 439/620; 439/271

(58) Field of Search ..... 439/620, 587, 439/589, 271, 76.1, 76.2

(56) References Cited

U.S. PATENT DOCUMENTS 4,473,267 A * 9/1984 Sadigh-Behzadi ..... 439/271
5,061,193 A * 10/1991 Seaman ..... 439/76
5,145,356 A * 9/1992 Minnis ..... 439/352
5,227,955 A * 7/1993 Le Bris et al. ..... 361/395
5,528,093 A * 6/1996 Adam et al. ..... 310/89
5,777,850 A * 7/1998 Jakob et al. ..... 361/736
6,186,814 B1 * 2/2001 Matsushita ..... 439/271

FOREIGN PATENT DOCUMENTS

| | | |
|---|---|---|
| JP | 9-245880 | 9/1997 |
| JP | 10-144385 | 5/1998 |
| JP | 10-172643 | 6/1998 |
| JP | 10-172645 | 6/1998 |

* cited by examiner

*Primary Examiner*—Tho D. Ta
*Assistant Examiner*—Larisa Tsukerman
(74) *Attorney, Agent, or Firm*—Sughrue Mion, PLLC

(57) ABSTRACT

An accessory 1 is mounted on a board 2, and a connector main portion 31 is formed by terminals 5 and a connector board 6, and one end portions of the terminals 5 are soldered to the board 2. A first sealing member 7 is provided at the connector main portion 31, and an inner housing 32, corresponding to the connector main portion 31, is formed within a receiving chamber 3*e* of a casing 3. A connector frontage portion 30*a* is formed at the casing 3. By mounting the board 2 on the casing 3, the first sealing member 7 is held in intimate contact with the inner housing 32 to seal the connector frontage portion 30*a*, and also a connector 30 is formed.

7 Claims, 9 Drawing Sheets

SEALING STRUCTURE OF ACCESSORY MODULE

BACKGROUND OF THE INVENTION

1. Field of the Invention

This invention relates to a sealing structure of an accessory module in which a casing, containing an accessory (e.g. an on-vehicle CCD camera) and a board, and wires, which are to be connected thereto, can be releasably connected together by the use of a ; connector, and besides a sealing performance is enhanced.

2. Related Art

Conventional camera modules Y and Z will be described with reference to FIGS. 7 to 10. FIG. 7 is an enlarged view of a portion of a wire harness 4 on which a clamp 50 with on O-ring 51 is mounted. A wire harness will be described briefly. Generally, a bundle of wires, used for connection to those electrical circuits of an automobile or the like except high-voltage circuits and an ignition circuit, is called a wire harness. Here, however, it means a wiring bundle comprising wiring elements (including wires) which are bundled together so that the mounting of wires or the like can be easily effected in an assembly line for automobiles. The wire harness is also called a wiring harness.

The O-ring 51, shown in FIG. 7, is provided on the clamp 50 so as to keep the interior of a camera casing 3 in an air-tight condition when the clamp 50 is attached to the camera casing 3. A clamp is a part used for mounting cables, such as a wire harness, on a mating structural object such as an automobile, and here it means a fastening member for fixedly mounting the relevant part.

The clamp 50 includes a threaded portion 50*a* for positively fixing this clamp to the camera casing 3, a hexagonal head 50*b* used when fixing the clamp 50 to the camera casing 3 by a thread-tightening operation, and a flange portion 50*c* which produces a force to fasten the clamp 50 and the camera casing 3 together, and also plays an important role in a sealing function of the O-ring 51.

A passage hole 50*d* for passing wires, such as cables 4*a* and 4*a*', therethrough is formed in the clamp 50. As shown in FIG. 7, the wires 4*a* and 4*a*', such as cables 4*a* and 4*a*' (including the drain wire 4*a*'), are passed through the passage hole 50*d* in the clamp 50 with the O-ring 51, and terminals TL1, that is, terminal members TL1, are secured to distal ends of the cables 4*a* and 4*a*', respectively. The terminals TL1 are received in a connector housing, and in this manner a connector CR1 is formed at the distal end of the wire harness 4 as shown in FIG. 8. The terminal designates a terminal member, and means an electrode.

The connector housing will be described briefly, and the connector housing is an electrically-insulating part which holds the terminals, that is, the terminal members, in a suitable arrangement pattern, and has the function of insulating the terminals from one another or from other conductors. Generally, the connector housing has receiving chambers in which the terminals or the like are mounted. The connector means apart for the purpose of achieving an electrical connection, and is provided with electrical connection parts, such as terminals and wires.

After the cables 4*a* and 4*a*' are passed through the passage hole 50*d* in the clamp 50 shown in FIG. 7, a potting processing PG is applied to this clamp. Here, the potting processing PG will be described briefly, and it means a process of pouring soft rubber, such as an epoxy polymer, or a soft resin into a predetermined portion to seal it.

By thus applying the potting processing PG, even each of the cables 4*a* and 4*a*' can be completely sealed so that the intrusion of moisture, dust, dirt and so on into the interior of the camera casing 3 and the interior of a camera 1 can be prevented. The confirmation of the sealing performance of the thus potting-applied portion is made by an operation for confirming the air-tightness and liquid-tightness by water leakage.

FIGS. 8 and 9 are a perspective view showing the manner of assembling the camera modules Y, Z provided with the conventional on-vehicle CCD camera 1. The camera module Y, provided with the conventional on-vehicle CCD camera, will be described briefly, and the camera module Y mainly comprises the camera 1, such as an on-vehicle CCD camera, and a board 2 on which this camera 1 is mounted. The camera module Z comprises the camera module Y, having the camera 1 mounted on the board 2, the camera casing 3 on which this camera module Y is mounted, and the wire harness 4 comprising the wires 4*a* and 4*a*' bundled together.

FIGS. 8 and 9 show the process of assembling the conventional on-vehicle CCD, and FIG. 9 is a perspective view specifically showing troubles encountered when mounting the camera module Y, comprising the camera 1 and the board 2, on the camera casing 3. FIG. 10 is a cross-sectional view taken along the line R—R of FIGS. 8 and 9, and also is a conceptual view showing an object to which the wire harness 4 is connected, and more specifically this figure is an enlarged, cross-sectional view showing a condition in which the wire harness 4 is mounted on the camera casing 3 through the clamp 50.

Here, a CCD will be described briefly, and the CCD mainly designates a charged-coupled device, and more specifically means a device which converts an optical signal, representing an image or the like, into an electrical signal by the use of a semiconductor device responsive to light. The CCD is an abbreviation of "Charge Coupled Device", and is a semiconductor made public in 1977 by Bell Laboratory of U.S.A. Generally, the picture quality of the CCD is mostly determined by the number of pixels, and the number of pixels of CCDs is set to the wide range of from several hundreds of thousands to several millions. It is surmised that the number of pixels is further increasing so as to meet the requirements made from now on.

CCDs have been extensively used in cameras, such as a digital camera and a video camera, and a facsimile machine, a scanner and a duplicating machine or a copying machine such as a laser beam printer. In the case of a digital camera, a CCD is provided at a focus portion instead of a silver salt film. Recently, CCDs, having a large number of pixels, have become inexpensive, and have much Contributed to the low-cost and high picture quality of digital cameras.

The parts of the conventional camera module Z, shown in FIGS. 8 to 10, will be described in detail, and first, the camera 1 mainly comprises a lens 1*c*, and a lens periphery portion 1*d* for fixing the lens 1*c*, as shown in FIGS. 8 and 9. Next, the board 2, on which the camera 1 is mounted, mainly comprises a board body 2', and electrical parts (such as connectors) for electrical connection are mounted on this board body 2'.

A connector CR2 is provided at the board 2 of the camera module Y provided with the CCD camera 1. A connector housing of the connector CR2, which is a kind of electrical associated part, is secured to the board body 2' by fastening elements such as screws. A total of four mounting holes 2*b*, used for fixedly securing the board 2 to the camera casing 3 by screws SC1 or the like, are formed respectively in those portions of the board body 2' disposed adjacent respectively to four corners thereof.

The camera casing 3 is formed by a bottom wall 3*c* and side walls 3*d* and 3*d*' provided respectively at four sides of this bottom wall in surrounding relation thereto, so that a receiving chamber 3*e* is formed. A cylindrical projected portion 3*h*, which performs the function of fixing the clamp 50 and also the function of sealing the interior of the camera casing 3, is formed on the side wall 3*d*'. Screw-fixing bodies 3*a*, to which the board 2, provided with the camera 1, is adapted to be fixedly secured, are provided respectively at four corners of the receiving chamber 3*e* of the camera casing 3, and an internally-threaded screw hole 3*b* is formed in each of the screw-fixing bodies 3*a*.

The condition of mounting of the clamp 50 on the camera casing 3, shown in FIGS. 8 and 9, will be described in detail with reference to FIG. 10, and a through hole 3*f* for passing the wire harness 4, comprising the bundle of cables 4 and 4', therethrough is formed through the side wall 3*d*' of the camera casing 3. An internally-threaded groove for threaded engagement with the threaded portion 50*a* of the clamp 50 to positively fix this clamp is formed in an inner peripheral surface of the through hole 3*f*.

The clamp 50 (shown in FIG. 7), having the cables 4*a* and 4*a*' passed therethrough, is mounted in the through hole 3*f* formed through the side wall 3*d*' of the camera casing 3. The threaded portion 50*a* of the clamp 50 is threadedly engaged in the through hole 3*f* of the camera casing 3, which is processed to have the threads, so that the clamp 50, having the wire harness 4 passed therethrough, is fixed to the camera casing 3 as shown in FIG. 10.

The cylindrical projected portion 3*h* is formed around the periphery of the through hole 3*f* in the camera casing 3 so that the clamp 50, provided with the above-mentioned O-ring 51, can be properly guided into the through hole 3*f* through this projected portion, and can be mounted therein. The cylindrical projected portion 3*h* maintains the air-tight condition, formed by the O-ring 51 mounted on the clamp 50, thus performing the function of a screen plate for preventing the intrusion of moisture, dust, dirt and so on from the exterior.

As shown in FIG. 10, the camera casing 3 is electrically connected by the wire harness 4 to a non-waterproof connector CR3 provided within a vehicle room V. A terminal TL2 is secured to one end of the drain wire 4*a* branching off from an intermediate portion of the wire harness 4, and the terminal TL2 is secured to a frame of a vehicle body B by a screw SC2. Thus, the drain wire 4*a*' performs the function of an earth.

As shown also in FIGS. 8 and 9, the connector CR1, comprising the connector housing in which the terminals, connected respectively to the cables 4*a* and 4*a*', are inserted, is connected to the connector CR2, provided at the board 2, in a male-female manner to form the male and female connectors, so that the cables 4*a* and 4*a*' are electrically connected to the camera 1 such as an on-vehicle CCD camera. In this manner, the board 2, provided with the camera 1, is electrically connected to the wire harness 4 and the non-waterproof connector CR3 within the vehicle room V, and the electrical connection of the drain wire 4*a*' is also made.

Grommets (not shown) are mounted on the wire harness 4 intermediate the opposite ends thereof. A grommet is an annular part made of rubber which protects a wire harness, a tube, a hose, a cable or the like from an edge portion of a through hole portion, formed in a vehicle body, a casing of a part or others, and is also used for the purpose of insulating dust, sound and so on. Because of its waterproof and dust-insulating nature, the grommet also functions as a sealing member. Grommets are used when passing a wire harness from a vehicle room to the exterior of the vehicle or when passing a wire harness from the vehicle room into an engine room or a trunk room.

One example of a method of assembling the on-vehicle CCD camera, shown in the prior art, will be described below in detail. First, the clamp 50, provided with the O-ring 51, is mounted on the wire harness 4 shown in FIG. 10. Then, the wire harness 4, comprising the bundle of cables 4*a* and 4*a*', is passed through the passage hole 50*d* in the clamp 50, thereby provisionally fixing the wire harness 4 and the clamp 50 to each other.

That portion of a tube 4*d* (which protects the cables 4*a* and 4*a*', and bundles them together), which is to extend beyond the clamp 50 into the camera casing 3, is cut by a knife or the like, so that the cables 4*a* and 4*a*' are taken out of the tube 4*d*. The terminals TL1 are already secured to the distal ends of the cables 4*a* and 4*a*', and these terminals TL1 are received in the connector housing to form the connector CR1 shown in FIG. 8.

In order to enhance the sealing between the wire harness 4 and the clamp 50 in this condition, the potting processing PG is applied by pouring a resin or rubber into the passage hole 50*d* in the clamp 50, thereby fixing the two together as shown in FIG. 7. The air-tightness within the camera casing 3 can be enhanced by the potting processing PG shown in FIGS. 7 and 10.

The above-mentioned operation for assembling the wires 4 and the peripheral parts of the wires 4 together will be called the assembly of the wire harness 4 and the connector, or may be merely called the connector assembly (assembly will be called "ASSY" in an abbreviated manner). In this case, the cables 4*a* and 4*a*' have a somewhat extra length as shown in FIGS. 8 and 9 so that these cables can connected the camera casing 3 to the board 2. Thus, the clamp 50 is fixed to the predetermined portion of the wire harness 4.

Next, the clamp 50, through which the cables 4*a* and 4*a*' have been passed as described above, is mounted in the through hole 3*f* in the camera casing 3. The threaded portion 50*a* of the clamp 50 with the O-ring 51 is threaded into the through hole 3*f*, that is, the internally-threaded hole, in the camera casing 3, thereby fixing the clamp 50 to the camera casing 3 as shown in FIGS. 8 to 10. At this time, the air-tightness and sealing performance within the camera casing 3 are maintained by the O-ring 51 and the potting processing PG as shown in FIG. 10.

After the preparations are thus made, the board 2, having the camera 1 mounted thereon, that is, the camera module Y, is mounted on the camera casing 3. With respect to the procedure of this assembly, first, the connector CR1, provided at the wire harness 4, is connected to the connector CR2, provided at the board body 2', to form the male and female connectors, as shown in FIGS. 8 and 9.

After the above-mentioned connectors are connected, the camera module Y is mounted on the camera casing 3. In this mounting method, first, the camera module Y, including the camera 1 and the board 2, is attached to the camera casing 3 in such a manner that the mounting holes 2*b*, formed in the board 2, are aligned respectively with the internally-threaded screw holes 3*b* provided respectively at the four corners of the camera casing 3.

Then, each screw SC1 is passed through the corresponding mounting hole 2*b* formed in the board body 2', and is screwed and tightened by screw fastening means. As a result, the screw SC1 is screwed into the internally-threaded screw hole 3*b* provided at the camera casing 3. In this manner, the board 2, provided with the camera 1, that is, the camera module Y, is fixedly secured to the camera casing 3, thus assembling the camera module Z.

With respect to peripheral techniques, there are disclosed JP-A-9-245880, JP-A-10-144385, JP-A-10-172643, JP-A-10-172644, JP-A-10-172645, JP-A-7-42075U and so on.

JP-A-9-245880 describes a relay connector for positively preventing a leakage of an oil liquid at a terminal insertion portion. JP-A-10-144385 describes improvements in drip-proof performance, moisture-proof performance and attaching/detaching operability of a wiring connector for a shelf illumination lamp incorporated in a showcase.

JP-A-10-172643 describes a waterproof connector for an electronic control unit in which the alignment of terminals can be easily secured, and the reflow soldering can be effected easily, and the good waterproof performance can be obtained. JP-A-10-172644 describes a waterproof connector for an electronic control unit in which the height of a male connector can be reduced, and the number of component parts can be reduced. JP-A-10-172645 describes a waterproof connector for an electronic control unit in which a male connector can be formed into a compact size, and a good appearance can be obtained.

JP-A-7-42075U describes a connector connecting apparatus. JP-A-7-42075U describes the connector connecting apparatus, in which conductors of a plurality of pair wires of a cable are automatically arranged on a provisionally-retaining cover of a connector, and an arrangement holding mechanism for automatically arranging the pair wires in a row without changing the order of combination of the pair wires.

However, in the above conventional camera module Z shown in FIGS. 8 and 9, when assembling this camera module Z, there was needed the operation in which the cables 4*a* and 4*a*' were passed from the exterior of the camera casing 3 into the receiving chamber 3*e* of the camera casing 3 through the through hole 3*f* (see FIG. 10) in the camera casing 3.

And besides, in order to enhance the sealing performance of the through hole 3*f* in the camera casing 3, there was needed the operation in which the clamp 50, mounted on the wire harness 4, was screwed into the threaded portion of the through hole in the camera casing 3, and was fastened to the camera casing 3.

Furthermore, there was needed the operation in which the connector CR1, secured to the distal ends of the cables 4*a* and 4*a*', was connected to the connector CR2, mounted on the board 2, in a male-female manner to make the electrical connection. Therefore, the assembling operation of the camera module Z must depend on manual operations, and therefore the workers were required to perform the complicated assembling operations. Thus, many complicated operations were needed for assembling the conventional camera module Z, and much production tact and production time were required, and this was not efficient from the viewpoint of productivity.

FIG. 9 is a perspective view showing troubles encountered when mounting the camera module Y on the camera casing 3. There was a fear that when mounting the conventional camera module Y on the camera casing 3, the cables 4*a* and 4*a*' were caught between the camera module Y and the camera casing 3 as shown in FIG. 9.

There was a fear that the conductors in the cable 4*a* or the drain wire 4*a*', caught between the camera module Y and the camera casing 3 in the assembling process, were cut, and therefore the camera module Z, having such cable 4*a* or drain wire 4*a*', must be treated as a defective product.

However, it is not desirable to discard such semi-finished products from the viewpoint of the global environment, and besides this is wasteful from the viewpoint of production, and therefore it was necessary to re-assemble the camera module Z while changing the wire harness 4 (including the cables 4*a*, the drain wire 4*a*' and the tube 4*d*) and those parts relevant to the wires 4, such as the clamp 50.

Besides the above catching problem that the cables 4*a* and 4*a*' were caught, the conventional camera module Z was not complete with respect to the waterproof measures. In the conventional camera module Z, the interior of the camera casing 3 was formed into the sealing structure, using the clamp 50, mounted on the wire harness 4, and so on, and the connector CR1, provided at the distal end of the wire harness 4 spaced from this clamp 50, was connected to the connector CR2, mounted on the board 2, in a male-female manner, thereby electrically connecting the wire harness 4 to the various electrical circuits on the board 2.

The camera module Z is thus formed into the sealing structure so as to prevent moisture from intruding into the camera 1. However, in the camera module Z shown in FIG. 8, any sealing measures are not provided at the connector CR2, mounted on the board 2, and the connector CR1 secured to the distal ends of the cables 4*a* and 4*a*'.

For example, if a cut W is accidentally formed in that portion of the tube 4*d* of the wire harness 4 extending outwardly from the camera module Z as shown in FIG. 10, and this cut reaches the conductors in the cable 4*a*, 4*a*' through an insulating sheath thereof, then rain water or the like intrudes into the camera module Z through the interior of the cable 4*a*, 4*a*'. Therefore, there was a fear that various troubles could develop in the camera module Z.

FIG. 6 is an enlarged, cross-sectional view of the cables 4*a* and 4*a*' bundled together in the wire harness 4. The cable 4*a*, 4*a*' comprises a plurality of conductors 4*b* and the insulating sheath 4*c*, and provides the conductor cable, and very small gaps 4*b*' are seen between the conductors 4*b*.

When rain water or the like intrudes into the cable 4*a*, 4*a*' through the above-mentioned cut W, the rain water advances forward along the cable 4*a*, 4*a*' because of a capillary action of the very small gaps 4*b*', existing between the plurality of conductors 4*b* bundled together in the cable 4*a*, 4*a*', and finally reaches the connectors CR1 and CR2 of the camera module Z shown in FIG. 9, and therefore there was a fear that the moisture intruded into the camera module Z.

A CCD camera is composed of precise electronic parts and mechanical parts, and therefore unless the camera module Z, having such a CCD camera mounted thereon, was completely maintained in a sealed condition relative to the exterior, there was a fear that there occurred various troubles such as an electrical trouble and the development of a cloud on the lens 1*c* of the camera 1.

More specifically, the troubles, which would be caused by the intrusion of the moisture into the camera module Z, are various problems such as the development of rust on the metallic parts, the incomplete electrical contact and the short-circuiting caused by the moisture, and the development of a cloud on the lens 1*c* by the condensation of the moisture, which prevents the satisfactory photographing.

It has been thought that these problems can be solved by applying waterproof measures to both of the connector CR2, provided at the board 2 of the camera module Z, and the connector CR1, secured to the distal ends of the cables 4*a* and 4*a*', thus forming these connectors into a waterproof connector. However, even if merely the waterproof connector is adopted in the camera module Z, the above catching problem still remains unsolved, and besides the following problems still remain unsolved.

When carrying out a maintenance operation for the camera 1, it has heretofore been necessary to recover the whole of the camera module Z including the wire harness 4, and much time and labor have been required for this recovering operation. Even if it is intended to effect the recovering operation for the camera module Z, including the wire harness 4, or to recycle and re-use the camera module Z in view of the global environment when a failure of the camera module Z occurs, many difficulties are involved in the above recovering operation when considering the contents of various operations required for recovering the camera module Z having the wire harness 4 connected thereto, and actually it has been thought impossible to carry out the recovering operation for the camera module Z.

SUMMARY OF THE INVENTION

In view of the above points, it is an object of this invention to provide a sealing structure of an accessory module in which a casing, containing an accessory, such as a camera, and a board, and wires, which are to be connected to this casing, can be easily connected together and disconnected from each other by the use of connectors, thereby solving the problem that the wires, such as cables, are caught between the camera casing and the board when assembling the conventional accessory module, and besides foreign matters, such as moisture, dust and dirt, are prevented from intruding into the interior of the accessory module, thereby enhancing a sealing performance.

Another object is to provide a sealing structure of an accessory module in which a casing, containing an accessory, and wires can be easily separated from each other so that the disassembly, inspection, repair and etc., of an accessory and its neighboring portions can be easily effected, thus providing an excellent maintenance performance.

The above objects have been achieved by a sealing structure of an accessory module of the present invention characterized in that an accessory is mounted on a board; and a connector main portion is formed by terminals and a connector board; one end portions of the terminals are soldered to the board; a first sealing member is provided at the connector main portion; an inner housing, corresponding to the connector main portion, is formed within a receiving chamber of a casing; a connector frontage portion is formed at the casing; and by mounting the board on the casing, the first sealing member is held in intimate contact with the inner housing to seal the connector frontage portion, and also a connector is formed.

Effectively, the other end portions of the terminals project toward an opening of the connector frontage portion, and insertion holes, corresponding respectively to the terminals, are formed through the first sealing member, and the terminals are press-fitted into the insertion holes, respectively, and the first sealing member is held in intimate contact with the connector board.

Effectively, a second sealing member is provided at a front portion of a mating connector secured to a cable, and when the mating connector and the connector are coupled together, the two are electrically connected together, and also a front surface portion of the mating connector is held in intimate contact with the first sealing member provided at the connector, and also the second sealing member, provided at the mating connector, is held in intimate contact with the inner housing of the casing to seal the connector.

Effectively, at least one lip, comprising at least one ridge, is formed on at least one surface of the first sealing member, the lip enhancing a sealing performance of the surface.

Effectively, by attaching a cover to the casing, a mating surface of the casing and a mating surface of the cover are abutted against each other, so that the accessory is sealed within the receiving chamber of the casing or a receiving chamber of the cover.

Effectively, a camera module is formed by using a camera, adapted to be mounted on an automobile, as the accessory.

DETAILED DESCRIPTION OF THE PREFERRED EMBODIMENTS

Figure 1:
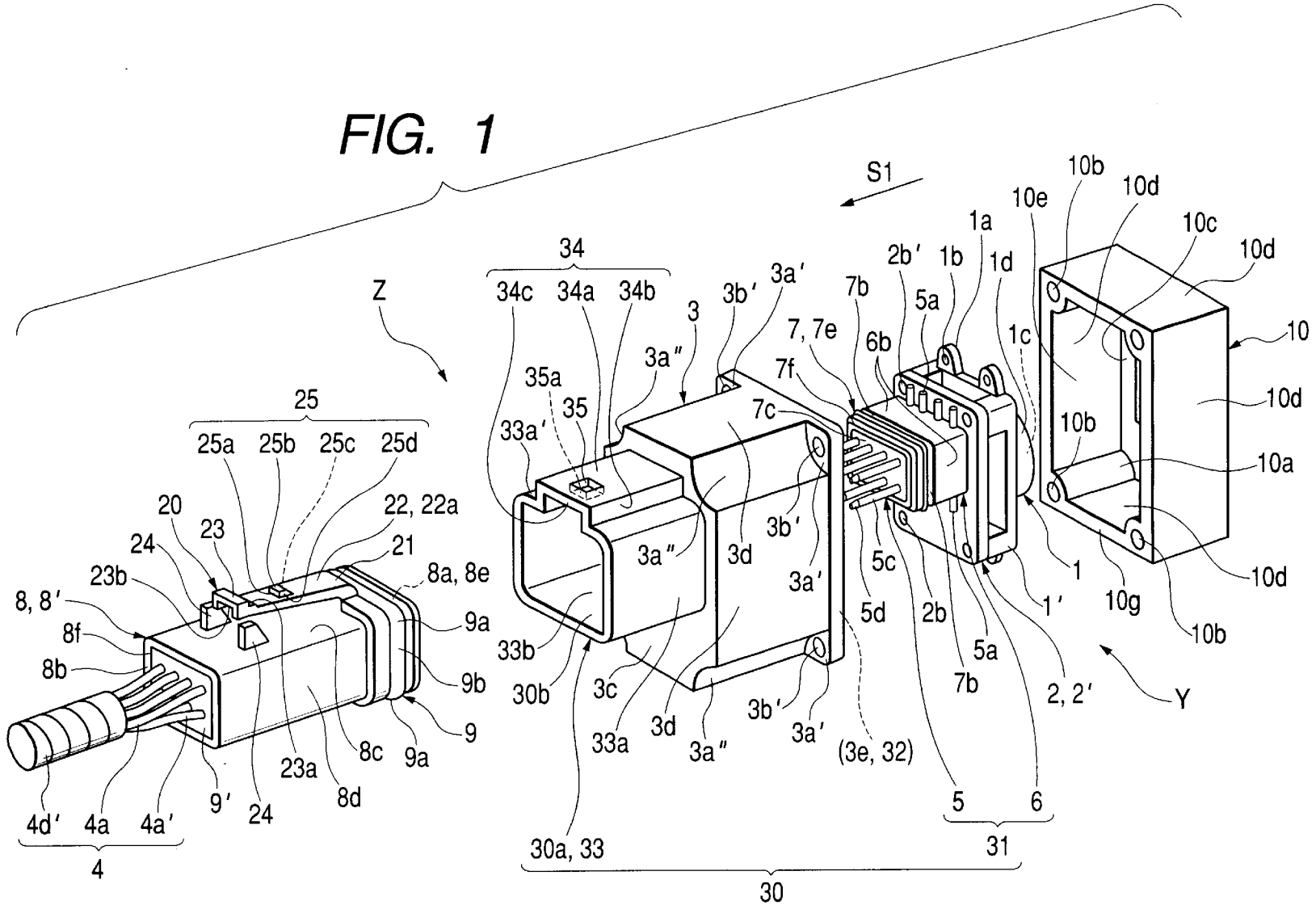
FIG. 1 is an exploded, perspective view of one preferred embodiment of an accessory module of the invention.

A camera module Z, which is one example of an accessory module Z of the present invention, will be described with reference to FIGS. 1 to 6. Those parts, having the same names as those of the conventional construction, will be designated by identical reference numerals, respectively, and detailed explanation of their structures will be omitted.

Figure 2:
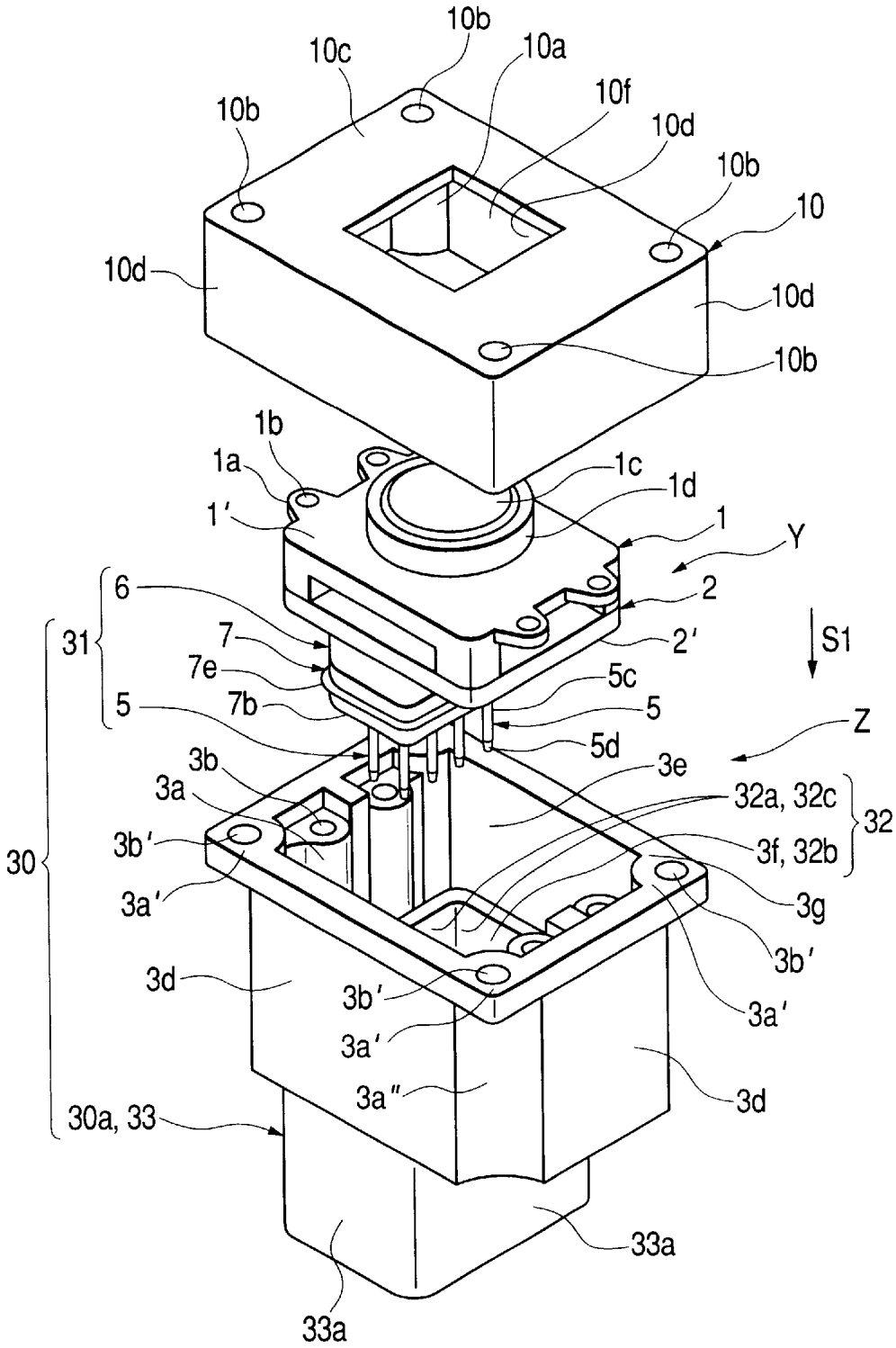
FIG. 2 is an exploded, perspective view of the accessory module.
Figure 3:
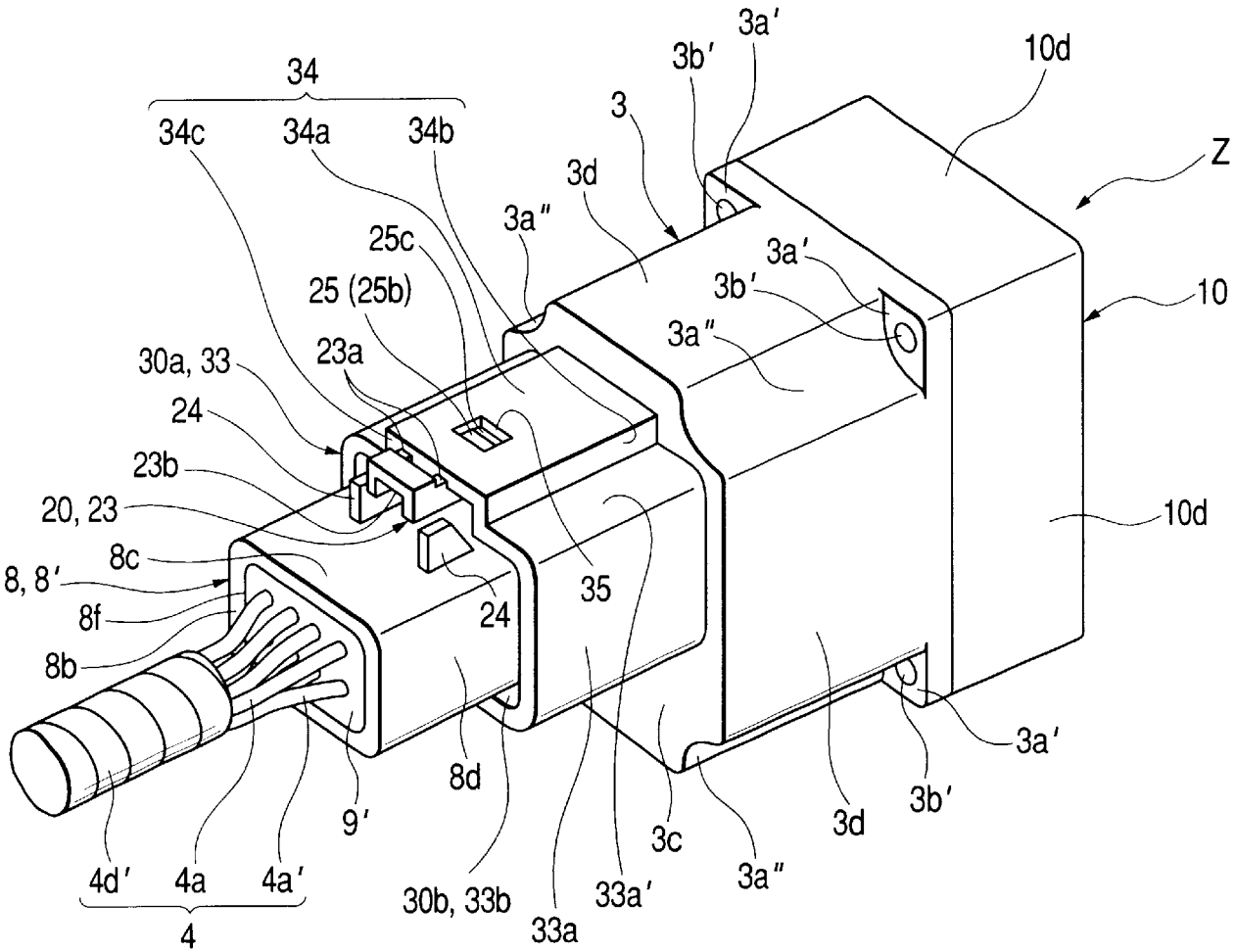
FIG. 3 is a view of the accessory module in its assembled condition.
Figure 4:
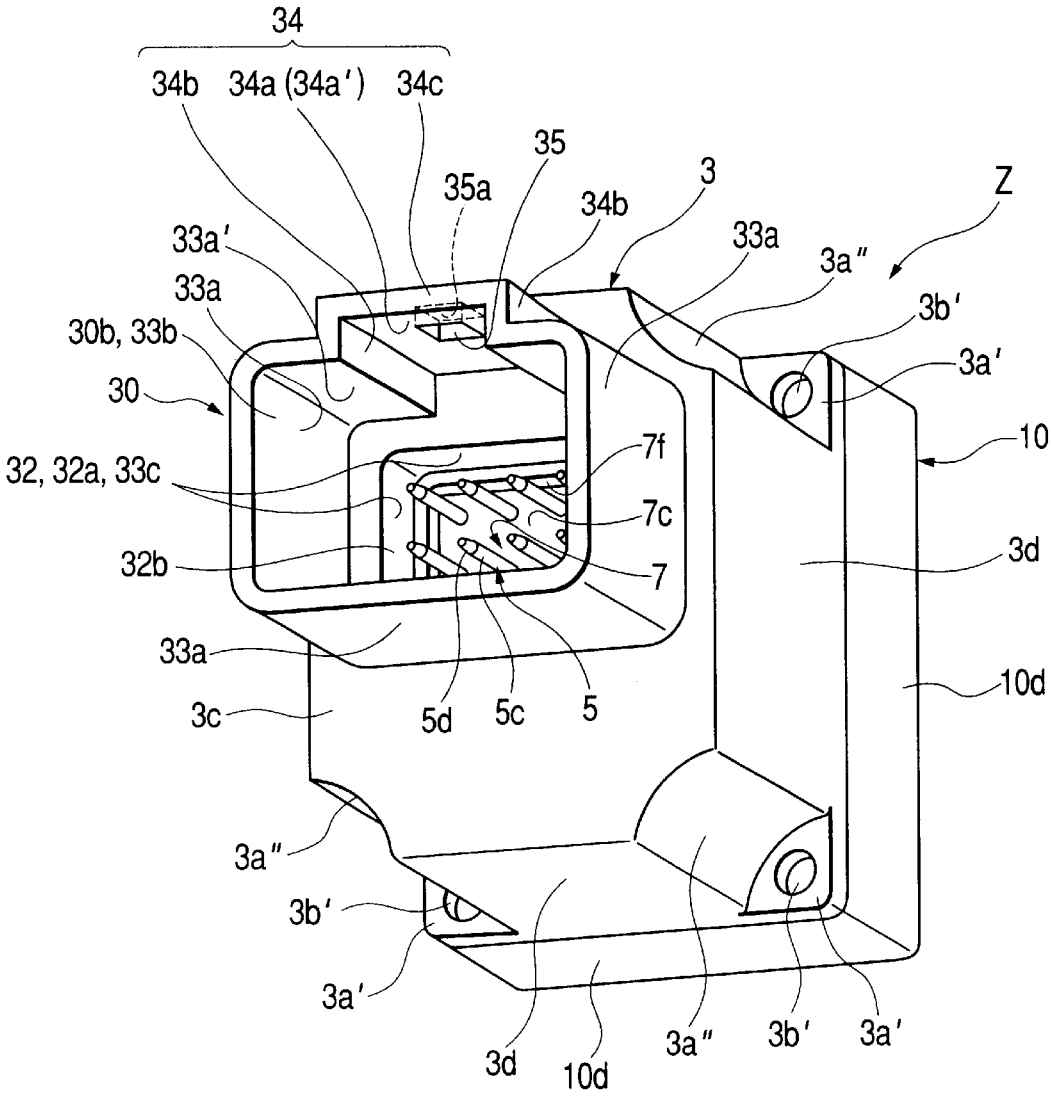
FIG. 4 is an enlarged, perspective view showing a condition in which a connector frontage portion is sealed by a first sealing member.
Figure 5:
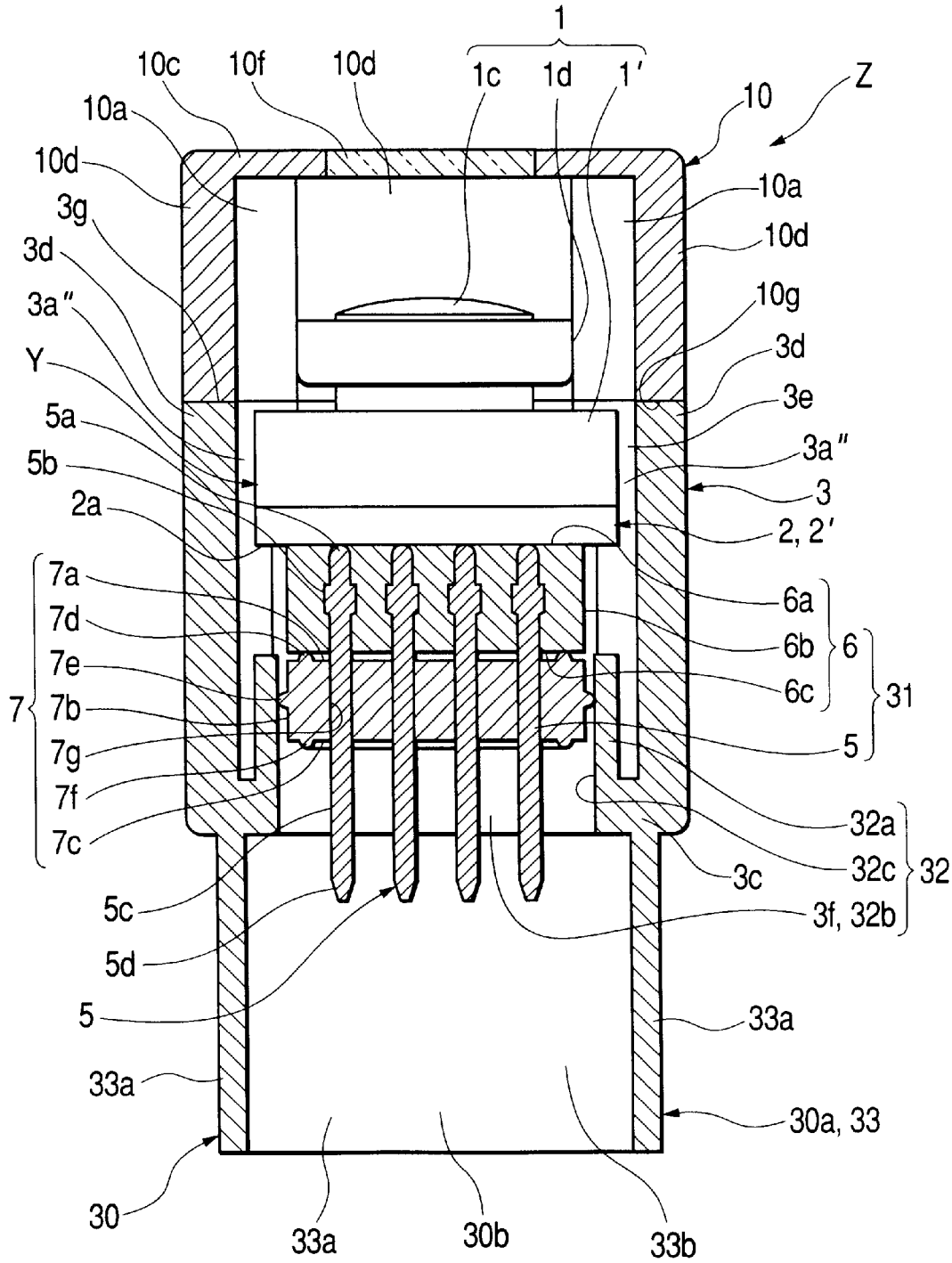
FIG. 5 is a longitudinal cross-sectional view of the accessory module.
Figure 6:
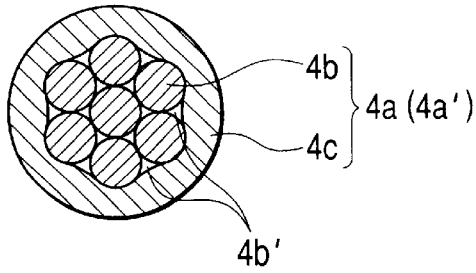
FIG. 6 is an enlarged cross-sectional view of a cable.

FIG. 1 is an exploded, perspective view of the camera module Z which is one preferred embodiment of the accessory module Z of the invention. FIG. 2 is an exploded, perspective view of the camera module Z. FIG. 3 is a view of the camera module Z in its assembled condition. FIG. 4 is an enlarged, perspective view showing a condition in which a connector frontage portion 30*a* is sealed by a first sealing member 7, that is, a rubber plug 7. FIG. 5 is a longitudinal cross-sectional view of the camera module Z. FIG. 6 is an enlarged cross-sectional view of a cable 4*a* or a drain cable 4*a*'.

The forward-rearward direction of the camera module Z will be described with reference to FIGS. 1 to 5. Here, that side of the assembled camera module Z, at which a lens 1*c* of the camera module Z is disposed, is the front side, and that side at which a base plate 3*c* of a camera casing 3 is disposed, that is, that side where wires 4, such as a wire harness 4, extends from the camera casing 3, is the rear side. With respect to a view as seen from the front side and a view as seen from the rear side, the view from the front side is a view of the connector as seen from the fitting side while the view from the rear side is a view of the connector as seen from the terminal inserting side, that is, the wire connecting side.

In this specification, the definitions of "front and rear" and "upper and lower" are merely used for convenience, sake, and such direction is not always in agreement with the direction of the accessory module Z in actual use. For example, in the process of assembling the accessory module Z, the accessory module Z, while directed at various angles, is assembled. Even if the accessory module Z of this invention is mounted in any posture, and is used, there is no problem in so far as the purpose of this invention is not impaired.

Next, an accessory module Y and the accessory module Z, described in this specification, will be explained. An assembly, comprising at least two component parts (that is, an accessory 1, such as a camera 1, and a board 2 attached thereto), is the accessory module Y, and is specifically called the camera module Y. An assembly, comprising at least three component parts (that is, the accessory 1, such as the camera 1, the board 2 attached to the accessory 1 such as the camera 1, and a casing 3, such as a camera casing 3, to which the board 2 is attached) is the accessory module Z, and is specifically called the camera module Z. In the invention, the camera modules Y and Z may be called "fitted members".

A connector, defined in this invention, includes electrical connection parts, such as terminals and wires, provided at a connector housing, and means a part for the purpose of electrical connection. Preferably, the connector in the invention is provided with sealing members such as a seal element, a rubber plug and a waterproof plug, and has an improved waterproof performance. Further, an additional part, such as a rear holder, may be attached to this connector.

As shown in FIGS. 1, 3 and 6, the wires 4, 4*a*, 4*a*' and 4*b* in this invention designate the wire harness 4, cables 4 or conductor cables, including a drain wire 4*a*', bare conductors 4*a* having no sheath. Here, the cables 4*a* and 4*a*' will be described briefly, and the cables 4*a* and 4*a*' are also called conductor cables, and each cable comprises a single conductor 4*b* or a plurality of conductors 4*b* protected by the insulating sheath 4*c* or an enamel material.

The camera, used in this invention, may be of any type such for example as a camera, employing a CCD, and a camera employing a MOS (which is an abbreviation of a Metal Oxide Semiconductor). The CCD has been briefly described above, and a charge-coupled device (CDD), used as one example of the invention, will be described.

The CCD mainly comprises photodiodes (that is, photosensitive elements), a transfer gate, and an overflow drain, and examples of the transfer type include a frame transfer type and an interline transfer type, depending on the manner of outputting the electric charge. Generally, in the CCD, a vertical transfer portion is provided at the side of a photosensitive portion, and a transfer gate is provided therebetween. For example, in such a CCD, a high-resistance board is adopted, and a p-well is provided below an n-layer of the vertical transfer portion, thereby preventing the photocharge, produced at the inner side of the board, from flowing into the transfer portion. By doing so, a smear phenomenon is suppressed.

In the CCD (charge-coupled device), the photosensitive portion, the overflow drain, the vertical and horizontal transfer portions are densely arranged on a silicone substrate of a square shape each side of which is less than 10 mm. About two hundred thousand to about six million of pixels are neatly arranged in a grid pattern. With respect to the number of pixels, for example, if pixels are arranged in a row of 2,000 and a column of 1,500, then the total number is 2,000×1,500=three million, and thus the number of the pixels is three million.

When an optical image of a subject is formed on the surface of such a silicone substrate through a lens, photoelectrons, of which number corresponds to its brightness, are produced in each pixel. Namely, the subject is converted into the electron image. Thereafter, a large number of pixels, thus arranged in a plane, are decomposed into horizontal scanning lines, thereby outputting these photoelectrons as video signals.

More specifically, the photocharges, produced by incident light, are shifted at a time to the vertical transfer CCD upon application of a transfer pulse thereto. Then, when a transfer pulse is applied to this vertical transfer CCD, this charge is sequentially transferred from one pixel to another in the CCD, and finally reaches the horizontal transfer CCD, and then the charges are successively transferred horizontally per horizontal scanning cycle, and are fed as a signal from an output portion.

Even if it is desired to make the CCD more sensitive, the sensitive portion of a large area can not be secured in some cases. As one example of means for solving this, there is used a charge-coupled device of a double-layer structure in which a photosensitive element of a high sensitivity like a target film of a pickup tube is superposed on a charge transfer portion. It is expected that in charge-coupled devices developed from now on, the high sensitivity of the same level as in a pickup tube, the improvement of the resolution and reduction of a moire effect by increasing the number of pixels, and the reduction of the image size are achieved, so that the CCDs of a high performance can be obtained at low costs.

Then, the MOS will be described, and the MOS means a metal oxide semiconductor, and is used mainly in an integrated circuit, and has an advantage that its power consumption is low. A charge-coupled device of the MOS type produces photocharges of which number corresponds to the intensity of the incident light, and it has a number of neatly-arranged pixels formed by a combination of photodiodes, having the function of temporarily accumulating the charges, and transistors serving as switches for taking out the accumulated charges.

Next, the various parts, forming the camera modules Y and Z, will be sequentially described in detail. As shown in FIGS. 1 and 2, the camera 1 includes a camera body 1', having a CCD, fixing portions 1*a*, mounting holes 1*b*, the lens 1*c*, and a lens periphery portion 1*d*. Four fixing portions 1*a* are provided at the camera body 1', and the mounting hole 1*b* is formed in each of these fixing portions 1*a*.

As shown in FIGS. 1, 2 and 5, a board body 2' of the board 2 has a generally rectangular parallelepiped shape. A plurality of circuit conductors (not shown), made of a metal foil such as a copper foil, are formed on the board body 2' made of an insulative resin, thus forming a printed circuit board. An insulating film is formed on the printed circuit board, including the circuit conductors, so as to prevent electrical troubles such as short-circuiting and electrical leak. In this manner, the printed circuit board 2 is formed.

Various electrical circuits each for electrical connection to its corresponding electrical wiring, such as relays, fuses, capacitors, semiconductors, terminals, bus bars, connectors and wires, are held on the board body 2' according to the need. The board 2 is a plate which thus holds the various electrical circuits, and has an insulating function for preventing improper electrical contact between the electrical circuits. This board 2 is thus required to have such performance, and therefore may be called an insulating board.

A total of four mounting holes, that is, two mounting holes 2*b* and two mounting holes 2*b*', are formed respectively in four corner portions of the printed circuit board 2. At least two fastening elements, such as screws (not shown), are threaded respectively into the mounting holes 2*b*, formed in the printed circuit board 2, thereby fastening the accessory 1, such as the camera 1, and the board 2 together.

Positioning projections are formed on the camera body 1' so that the camera body 1' and the board body 2' can be fixed together in precisely-positioned relation to each other. For example, at least two positioning pins, serving as such positioning projections, are formed respectively at two diagonally-disposed ones of the four corner portions of the camera body 1' having a generally rectangular shape as seen from that side where the wires 4 are disposed. At least two mounting holes 2*b*' for positioning purposes, corresponding respectively to these positioning pins, are formed respectively at two diagonally-disposed ones of the four corner portions of the board body 2' having a generally rectangular shape as seen from that side where the wires 4 are disposed. The positioning pins are fitted respectively into the positioning-purpose mounting holes 2*b*', so that the camera body 1' and the board body 2' can be combined together precisely.

The positional relation between the positioning pins and the positioning-purpose mounting holes 2*b*' may be reversed in so far as the camera 1 and the board 2 can be precisely combined together. For example, the positioning pins may be formed perpendicularly on the board body 2' while the mounting holes, corresponding respectively to these pins, may be formed in the camera body 1', and these pins are fitted respectively in these mounting holes, so that the camera body 1 and the board 2 can be precisely combined together.

As shown in FIGS. 1 and 5, a connector board 6 is provided on a rear surface 2*a* of the board 2. This connector board 6 is in the form of a hexahedron of a rectangular parallelepiped shape having a front surface 6*a* of a generally rectangular shape, a rear surface 6*c* of a generally rectangular shape, and four side surfaces 6*b* interconnecting the front and rear surfaces 6*a* and 6*c*. Male terminals 5 each in the form of a round pin are integrally provided at this connector board 6.

The rear surface 6*c* of the connector board 6 is defined by a smooth surface so that a front surface 7*a* of the first sealing member 7 (that is, the rubber plug 7), including a front lip 7*d*, can be held in intimate contact with this smooth surface to achieve a good sealing effect. The connector board 6 is also made of an insulative resin material so as to prevent electrical troubles such as electrical leak and short-circuiting.

A material, of which the board 2 and the connector board 6 are molded, will be described. For example, if a synthetic resin, such as a thermosetting resin or a thermoplastic resin, is used, this is preferable since such a resin is excellent in moldability, and can satisfactorily insulate the various electrical parts such as various bus bars or various terminals. If this synthetic resin (one of the above two synthetic resins) has low water absorption properties, this is preferable since it is excellent in dimensional stability and mass productivity, and has a stable electrical performance. In view of the rapid moldability, for example, a hot-melt material such as a polyamide resin can be chosen as a thermoplastic synthetic resin for forming the connector board 6 and so on.

A male terminal will be described. The male terminal is a mating terminal for a female terminal, and can be inserted into the female terminal to be electrically connected thereto, and examples of male terminals include a tab type, a round pin type and a square pin type. Instead of round pin-type male terminals, male terminals of any other suitable shape, such as a square pin-type and a tab-type (having a flat plate-shape), can be used as the male terminals 5 in the invention.

The male terminal 5 of a round pin-shape will be described with reference to FIG. 5 first with respect t o one end portion thereof. The male terminal 5 mainly has a proximal end portion 5*a* (including that portion disposed adjacent to a proximal bent portion 5*a*), and a support shank portion 5*c* extending straight, and a distal end portion 5*d* is formed at the other end of the male terminal 5. A projected portion 5*b* is formed at that portion of the support shank portion 5*c* of the male terminal 5, disposed adjacent to the proximal bent portion 5*a*, so that the male terminal 5 is positively fixed to the connector board 6, and will not be angularly moved about its axis or shaken relative to the connector board 6.

As shown in FIGS. 1, 2, 4 and 5, the distal end portion 5*d* of the male terminal 5 is formed into a generally conical shape so that it can be easily inserted into a through hole 7*g* in the rubber plug 7, and can be easily inserted into the mating female terminal.

For example, the male terminals 5 of a round pin-shape are insert molded in the connector board 6 during the injection molding of this connector board 6, and the male terminals 5 are formed integrally with the connector board 6 to form a connector main portion 31. This connector main portion 31 may be called a connector for a board.

Referring to FIGS. 1, 2 and 5, two rows of round pin-shaped male terminals 5 are arranged on the rear surface 6*c* of the connector board 6, and each row has four terminals 5 spaced at equal intervals, and therefore the total number of the terminals is eight. The male terminals 5 project generally perpendicularly from the rear surface 6*c* of the connector board 6 (FIG. 5). As shown in FIG. 5, the proximal end portions 5*a* of one row of (that is, four) male terminals 5 and the proximal end portions 5*a* of the other row of (that is, four) male terminals 5 project from those portions of the respective side surfaces 6*b* of the connector board 6, disposed adjacent to the front surface 6*a*, in directions away from each other, and extend parallel to the rear surface 2*a* of the printed circuit board 2, and are held in contact with the rear surface 2*a* of the printed circuit board 2.

Namely, one end portions of the four male terminals 5 project from one side surface 6*b* of the connector board 6, and similarly the four male terminals 5 project from that side surface 6*b* facing away from the one side surface 6*b*. The thus projected proximal end portions 5*a* of the male terminals 5 are electrically connected by soldering to the circuit conductors which are formed on the printed circuit board 2, and are made of a metal foil such as a copper foil. As can be seen from FIG. 1, the male terminals 5 are bent generally perpendicularly in the connector board 6, and the other end portions of the eight male terminals 5 project from the rear surface 6*c* of the connector board 6 toward the connector frontage portion 30*a*.

Examples of materials for forming the terminals (the male terminals 5 and the female terminals corresponding to these male terminals 5) or bus bars, used in the invention, include a copper-base material, such as bronze, brass and a copper alloy, and an aluminum alloy. The male terminals 5 and the female terminals or the bus bars, used in the invention, may be made of any material in so far as it is, for example, a metal material of electrical conductivity, and is a conductor resistant to heat produced by soldering.

A surface protection treatment, such as plating, may be applied to the above material in order to enhance its corrosion resistance. However, if the material can sufficiently maintain its performance under ordinary conditions of use, it is preferred to omit such a surface protection treatment from the viewpoint of the reduction of the cost.

A bus bar is formed of an electrically-conductive metal sheet, and has branched electrical circuits, and the bus bar is formed by an electrical network having a number of electrical contact piece portions. Examples of bus bars include a bus bar body, a connector bus bar, a relay bus bar, a fuse bus bar and a power bus bar. The fuse bus bar is called a gripping terminal or a tuning fork-type terminal because of its shape. Relay terminals, such as an F—F terminal, may be attached to the above bus bars if necessary.

The F—F terminal will be described briefly, and the F—F terminal is a terminal having female fitting portions formed respectively at opposite ends thereof. Different types of F—F terminals are selectively used, depending on parts to which these are connected, and for example, a fuse F—F terminal is used for connecting a bus bar to a fuse, and a relay F—F terminal is used for connecting a bus bar to a relay. The term "F" of the F—F terminal means the word "female" of the foreign language.

There is the type of bus bar in which male terminal portions are formed integrally with a bus bar body by pressing, and the use of such a bus bar is preferred since the number of component parts is not increased, so that the cost can be reduced. The male terminal portion of such a bus bar is called a tab. The tab, formed at that portion of the bus bar disposed adjacent to an end portion thereof, performs the function of a terminal.

As shown in FIG. 5, the rear surface 2*a* of the printed circuit board 2 is abutted against the front surface 6*a* of the connector board 6 forming the connector main portion 31, and the connector main portion 31 is mounted on the printed circuit board 2. The male terminals 5 of the connector main portion 31 are soldered respectively to predetermined portions of the circuit conductors (formed by a metal foil such as a copper foil) formed on the board body 2', and therefore is integrally connected thereto, and thus the connector main portion 31 is provided as part of the board 2.

The type of connector, which is soldered to circuit conductors of a metal foil formed on a printed wiring board such as the printed circuit board 2, is called a PCB connector. The term "PCB" means "printed circuit board". Generally, male terminals, used in the PCB connector, are square pin-type male terminals. However, the terminals of the connector, used in the invention, may be of any type.

PCB connectors are mainly classified into two mounting types, that is, a vertically-mounting type and a horizontally-mounting-type. The vertically-mounting-type PCB connector is of such a type that the direction of mutual connection of male and female terminals is perpendicular to the printed circuit board. On the other hand, the horizontally-mounting-type PCB connector is of such a type that the direction of mutual connection of male and female terminals is horizontal or parallel to the printed circuit board.

As shown in FIG. 5, the first sealing member 7, that is, the rubber plug 7, made of silicone rubber, is mounted on the male terminals 5 of the connector main portion 31 in order to enhance the sealing performance. As can be seen from FIGS. 1 and 5, this rubber plug 7 is a sealing member in the form of a hexahedron of a rectangular parallelepiped shape having a front surface 7*a* of a generally rectangular shape, a rear surface 7*c* of a generally rectangular shape, and a peripheral surface 7*b* (having four side surfaces) interconnecting the front and rear surfaces 7*a* and 7*c*.

In order that this rubber plug 7, when press-fitted into an inner housing 32 of the camera casing 3, can achieve a good sealing effect, each of four corner portions of the peripheral surface 7*b* (having the four side surfaces) of the rubber plug 7 is formed into a gently-curved shape as show in FIGS. 1 and 2. Thus, the rubber plug 7, shown in FIGS. 1 and 2, has the shape corresponding to a rectangular shape of the box-like inner housing 32. The rubber plug 7 and the connector board 6 have a rectangular shape as seen from the rear side, but may have any other shape such as a circular shape.

The connector main portion 31, secured to the printed circuit board 2 by solder, and the PCB connector, secured in such a manner, are exposed to heat during the soldering operation. Therefore, preferably, the rubber plug 7, mounted on the connector main portion 31 or the PCB connector, is made of silicone rubber having excellent heat resistance.

As shown in FIG. 5, at least one lip 7*d*, 7*e*, 7*f*, each comprising one ridge, is formed on at least one of the surfaces 7*a*, 7*b* and 7*c* of the rubber plug 7 so as to enhance the sealing effect of this surface 7*a*, 7*b*, 7*c*.

This will be described specifically with reference to FIGS. 1 and 4. One ridge-shaped lip 7*f* of a rectangular annular shape (having no end), similar to the outer periphery of the rectangular rear surface 7*c*, is formed on this rear surface 7*c* of the rubber plug 7. Similarly, one ridge-shaped lip 7*d* of a rectangular annular shape (having no end), similar to the outer periphery of the rectangular front surface 7*a*, is formed on this front surface 7*a* of the rubber plug 7. As can be seen from FIG. 1, one ridge-shaped peripheral lip 7*e* of a rectangular annular shape (having no end) is formed on the rectangular peripheral surface 7*b* (having the four side surfaces) of the rubber plug 7 over the entire periphery thereof.

Thus, at least one lip 7*d*, 7*e*, 7*f*, each comprising one ridge, is formed on at least one of the surfaces 7*a*, 7*b* and 7*c* of the rubber plug 7 so as to enhance the sealing effect of this surface 7*a*, 7*b*, 7*c*. Therefore, the lips 7*d*, 7*e* and 7*f*, when squeezed by the mating members (that is, the sealing objects), produce a restoring force, so that a positive seal is formed between the rubber plug 7 and the mating members (that is, the sealing objects).

If the surfaces 7*a*, 7*b* and 7*c* of the rubber plug 7 are designed to be slightly squeezed by the mating members (that is, the sealing objects) so that the restoring force can be produced generally over an entire area of this rubber plug 7, the degree of intimate contact between the rubber plug 7 and each mating member (that is, the sealing object) is further increased, thus enhancing the sealing performance.

The rubber plug 7, shown in FIG. 5, is illustrated for convenience' sake, that is, for the better understanding of the front surface 7*a* and the front lip 7*d*, the peripheral surface 7*b* and the peripheral lip 7*e* and the rear surface 7*c* and the rear lip 7*f*. For example, the front surface 7*a* of the rubber plug 7 and the rear surface 6*c* of the connector board 6, as well as the peripheral surface 7*b* of the rubber plug 7 and an inner peripheral surface 32*c* of the inner housing 32, may be formed such that when the rubber plug 7 is press-fitted into the inner housing 32 of the camera casing 3, those portions of the surfaces 7*a* and 7*b*, allowed for sealing or squeezing, are squeezed to produce a restoring force, thereby holding the surfaces 7*a* and 7*b* in intimate contact with the connector board and the inner housing, respectively.

The insertion holes 7*g* are formed through the rubber plug 7, and the round pin-shaped male terminals 5 are press-fitted into these through holes, respectively. Each male terminal 5 is satisfactorily sealed by this rubber plug 7 over a region, extending from an intermediate portion of the support shank portion 5*c* to the connector board 6, and extends to the printed circuit board 2.

The rubber plug 7 comprises a separate member for mounting on the terminals 5 of the connector main portion 31 as described above, but may be molded integrally on the connector main portion 31 comprising the terminals 5 and the connector board 6.

In the case where the rubber plug 7 is molded integrally on the connector main portion 31 comprising the terminals 5 and the connector board 6, the shrinkage of the rubber molded product, developing after the molding, and the shrinkage of the rubber molded product, developing during a vulcanizing process, that is, a heat treatment, for forming the molded product into a rubber-like elastic member, can be utilized, and therefore the terminals 5, provided at the connector main portion 31, are positively gripped by the rubber plug 7 in a sealed condition. Each terminal 5 is positively sealed over the region, extending from the intermediate portion of the support shank portion 5*c* to the connector board 6, and extends to the printed circuit board 2, and besides a positive seal is formed between the rubber plug 7 and the connector board 6.

In the manner described above, the accessory module Y, such as the camera module Y shown in the embodiment of the invention, is formed. More specifically, the accessory module Y, such as the camera module Y shown in the embodiment of the invention, is the assembly which comprises the accessory 1 such as the camera 1, the printed circuit board 2 formed as a printed wiring board, the connector main portion 31, comprising the round pin-shaped male terminals 5 and the connector board 6, and the first sealing member 7, such as the rubber plug 7, provided at this connector main portion 31.

As can be seen from FIGS. 1 and 2, the camera casing 3 is formed by the base plate 3*c* and side walls 3*d* provided respectively at four sides of this base plate 3*c* in surrounding relation thereto, so that a receiving chamber 3*e* is formed. As shown in FIG. 2, fixing portions 3*a* and internally-threaded screw holes 3*b*, corresponding to the four fixing portions 1*a* and mounting holes 1*b* provided at the camera 1 of the camera module Y shown in FIGS. 1 and 2, are provided at four portions within the receiving chamber 3*e* of the camera casing 3 for the purpose of mounting the camera module Y on the camera casing.

As shown in FIGS. 1 and 2, flange-like fixing portions 3*a*' and mounting holes 3*b*', corresponding to fixing portions 10*a* and mounting holes 10*b*, provided at four corner portions of a cover 10 to be attached to the camera casing 3, are provided at the four corner portions of the front surface of the camera casing 3.

Fastening element relief portions 3*a*", corresponding to the fixing portions 3*a*' and the mounting holes 3*b*' formed at the outer surface of the camera casing 3, are formed respectively in the four corner portions of the camera casing 3 (at which the side walls 3*d* of the camera casing 3 intersect) in which fastening elements, such as a screw, a bolt or a nut of a special shape, can be disposed, respectively. These fastening element relief portions 3*a*" are formed by notching the four corner portions of the camera casing 3, so that these corner portions have a notched configuration.

As shown in FIG. 2, a mating surface 3*g*, which is defined by a flat surface, and corresponds to a mating surface 10*g* formed at ends of side walls 10*d* of the cover 10 shown in FIG. 1, is formed at the front ends of the side walls 3*d* of the camera casing 3 so that when the cover 10 is attached to the camera casing 3, the camera module Y can be sealingly isolated from the exterior. A through hole 3*f* extends from the receiving chamber 3*e* of the camera casing to the exterior of the camera casing 3, and this through hole 3*f* is continuous with an opening 30*b* in the connector housing 33 through the connector frontage portion 30*a*.

The connector housing 33, forming the connector frontage portion 30*a* provided at the camera casing 3, and the inner housing 32, provided in the receiving chamber 3*e* of the camera casing 3 in corresponding relation to the connector frontage portion 30*a*, will be described in detail. Here, a housing will be described briefly, and the housing is a box or a box-like member for housing articles, such for example as a box-like portion for housing a part or a frame for housing a machine. The inner housing 32 may be called an inner casing.

As shown in FIGS. 1 and 4, the connector housing 33 is formed by four side walls 33*a* and 33*a*', and has a generally-rectangular box-like shape as seen from that side where the wires 4 are disposed, and a mating connector-receiving chamber 33*b* is formed in this connector housing. A lock arm receiving portion 34 for receiving a lock arm 20 of a mating connector 8 is formed at the side wall 33*a*' of the connector housing 33. The lock arm receiving portion 34 is formed by two side walls 34*b* and 34*b*, disposed parallel to each other, and a side wall 34*a*, interconnecting the two side walls 34*b* and 34*b*, and has a generally U-shape space defined by these side walls 34*a*, 34*b* and 34*b*.

As the mating connector 8 is inserted into the connector 30 of the camera module Z, a sliding contact surface 25*b* of a lock projection 25, formed on the lock arm 20, slides on a sliding contact surface 34*a*' defined by an inner surface of the side wall 34*a* of the lock arm receiving portion 34.

Thus, the connector housing 33, as well as the mating connector-receiving chamber 33*b*, is formed by the side wall 33*a*' (including the side walls 34*a* and 34*b* of the lock arm receiving portion 34) and the other three side walls 33*a*, thereby forming the connector frontage portion 30*a*. A rear end surface 34*c* of the lock arm receiving portion 34, shown in FIGS. 1 and 4, serves also as a stop wall against which front surfaces of step portions 23*a*, formed on a front side of an operating portion 23 of the lock arm 20, can abut, as shown in FIG. 3.

As shown in FIGS. 1, 3 and 4, an engagement portion 35 (more specifically, engagement hole 35) for retaining engagement with the retaining portion 25 of the lock arm 20 (shown in FIGS. 1 and 3), formed on the mating connector 8, is provided at the side wall 34*a* of the generally U-shaped lock arm receiving portion 34 of the connector housing 33.

The engagement hole 35, formed through the side wall 34*a* of the lock arm receiving portion 34, is defined by an engagement surface 35*a* defined by its rear surface, a side surface opposed to this engagement surface 35*a*, and two side surfaces disposed perpendicular to the engagement surface 35*a* and intersecting this side surface. Thus, the engagement hole 35, formed in the connector housing 33, is a through hole having a rectangular shape corresponding to the shape of the lock projection 25 of the mating connector 8.

The retaining surface 35*a* of the engagement hole 35, formed in the connector housing 33, and the rear end surface 34*c* of the lock arm receiving portion 34, formed at the connector housing 33, are generally parallel to each other, and play important roles in the retaining and engagement relative to the lock arm 20 formed on the mating connector 8 shown in FIG. 1.

As shown in FIG. 4, the engagement surface 35*a* of the engagement hole 35, formed in the connector housing 33, perpendicularly intersects the inner surface of the side wall 34*a* of the lock arm receiving portion 34 including the sliding contact surface 34*a*'. The engagement surface 35*a* of the engagement hole 35 (shown in FIGS. 1 and 4), formed in the connector housing 33, corresponds to a retaining surface 25*a* of the lock projection 25 formed on the lock arm 20 of the mating connector 8 shown in FIG. 1.

As shown in FIGS. 2 and 5, the inner housing 32 is provided within the receiving chamber 3*e* of the camera casing 3. The inner housing 32 has a rectangular tubular shape defined by four side walls 32*a*, and thus a sealing member-receiving portion 32*b* is formed. The sealing member-receiving portion 32*b* also serves as the through hole 3*f* extending from the receiving chamber 3*e* of the camera casing 3 to the connector frontage portion 30*a*.

An inner peripheral surface 32*c* of the inner housing 32 is formed into a smooth surface so as to be held in intimate contact with the peripheral surface 7*b* (including the peripheral lip 7*e*) of the first sealing member 7, that is, the rubber plug 7, to form a satisfactory seal therebetween, and also so as to be held in intimate contact with an outer peripheral surface 9*b* of a second sealing member 9, that is, an O-ring-shaped seal element 9, to thereby form a satisfactory seal therebetween. Each of four corner portions of the inner housing 32 is formed into a gently-curved surface so that the rubber plug 7 and the seal element 9 can be intimately contacted with the inner housing 32 uniformly over the entire periphery thereof to achieve the good sealing effect.

The inner housing 32 and the connector housing 33 are formed integrally with each other by injection molding, using the same material as that of the casing 3 such as the camera casing 3, and therefore the number of the component parts is not increased. And besides, the inner housing 32 and the connector housing 33 are molded integrally with the casing 3 such as the camera casing 3, and therefore there is no need to carry out a two-color molding or a secondary molding, and therefore the production process will not become complicated by such molding method, so that the cost of the accessory module Z, such as the camera module Z, will not increase.

For example, if the camera casing 3 and the camera body 1' of the camera 1 are formed of an aluminum alloy such as a diecast aluminum alloy, this is preferable since this material is lightweight, and is excellent in many points such as the mechanical strength, corrosion resistance, processability and productivity.

The CCD camera, mounted on the outer side of an automobile, is exposed to rain and wind, and it is important for this camera to have corrosion resistance, and it is preferred that the material thereof have a lower specific gravity so as to contribute the lightweight design of the automobile. It is preferred that the material for the camera casing 3 or the camera body 1', used for such purpose, be an aluminum alloy or a synthetic resin which can be injection molded, and has a thermoplastic nature, since such material is excellent from the viewpoint of mass productivity.

With respect to the sealing structure of the camera module Z of the invention, detailed description will be made, with reference to FIGS. 1, 2 and 5, of a condition in which the connector frontage portion 30*a* is sealed by the rubber plug 7 upon fitting of this rubber plug into the inner housing 32 within the receiving chamber 3*e* of the camera casing 3 at the time of mounting the assembled camera module Y (comprising the camera 1, the board 2, the connector main portion 31, the rubber plug 7 and so on) on the camera casing 3.

As shown in FIGS. 1 and 2, the printed circuit board 2 is mounted on the camera 1, and the connector main portion 31 is formed by the male terminals 5 and the connector board 6, the proximal end portions (one end portions) 5*a* of the male terminals 5 are soldered to the circuit conductors (formed by a metal foil such as a copper foil) formed on the printed circuit board 2, and the rubber plug 7, which performs the sealing function, is provided at the connector main portion 31. Thus, the camera module Y is formed.

As shown in FIG. 2, the inner housing 32, corresponding to the connector main portion 31, is formed within the receiving chamber 3*e* of the camera casing 3, and the connector frontage portion 30*a* is formed at this camera casing 3. As shown in FIGS. 1 and 2, the printed circuit board 2, which is provided with the camera 1 and the connector main portion 31 with the rubber plug 7, that is, the camera module Y, is inserted into the receiving chamber 3*e* of the camera casing 3 in a mounting direction S1, and is mounted on the camera casing.

When the camera module Y is thus mounted on the camera casing 3, the rubber plug 7 is press-fitted into the inner housing 32 of the came casing 3 as shown in FIG. 5 (which is a conceptual view), and the peripheral surface 7*b* of the rubber plug 7 and the peripheral lip 7*e*, formed on the peripheral surface 7*b* of the rubber plug 7, are held in intimate contact with the inner peripheral surface 32*c* of the inner housing 32, thereby sealing the connector frontage portion 30*a*, and also the connector 30 is formed as shown in FIGS. 4 and 5.

By doing so, the camera 1 and the wire harness 4 can be made independent of each other, and therefore the various parts to be received in the camera casing 3 can be assembled in a process different from the process for the wire harness 4, and the assembling efficiency is improved. It is not necessary to effect the cumbersome assembling operation as in the prior art technique, and the rapid assembling operation of the camera module Z can be carried out.

In contrast with the prior art technique, the camera module Z is assembled, using the connector main portion 31 having the male terminals 5, and therefore the connector 30 can be easily formed at the camera module Z during the assembling operation. Therefore, the assembling operation of the camera module Z can be automated.

Figure 7:
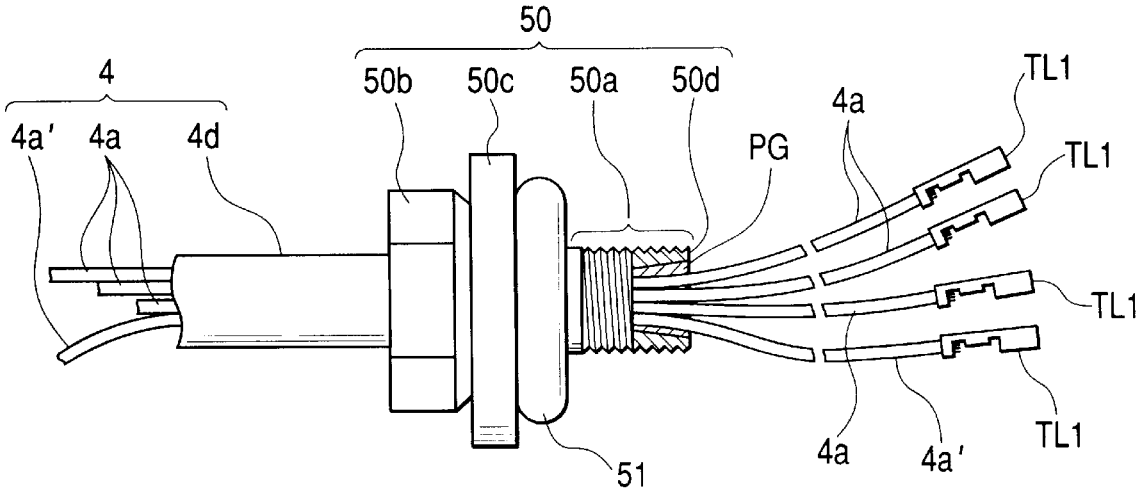
FIG. 7 is an enlarged view of a portion of a wire harness having a clamp mounted thereon.
Figure 8:
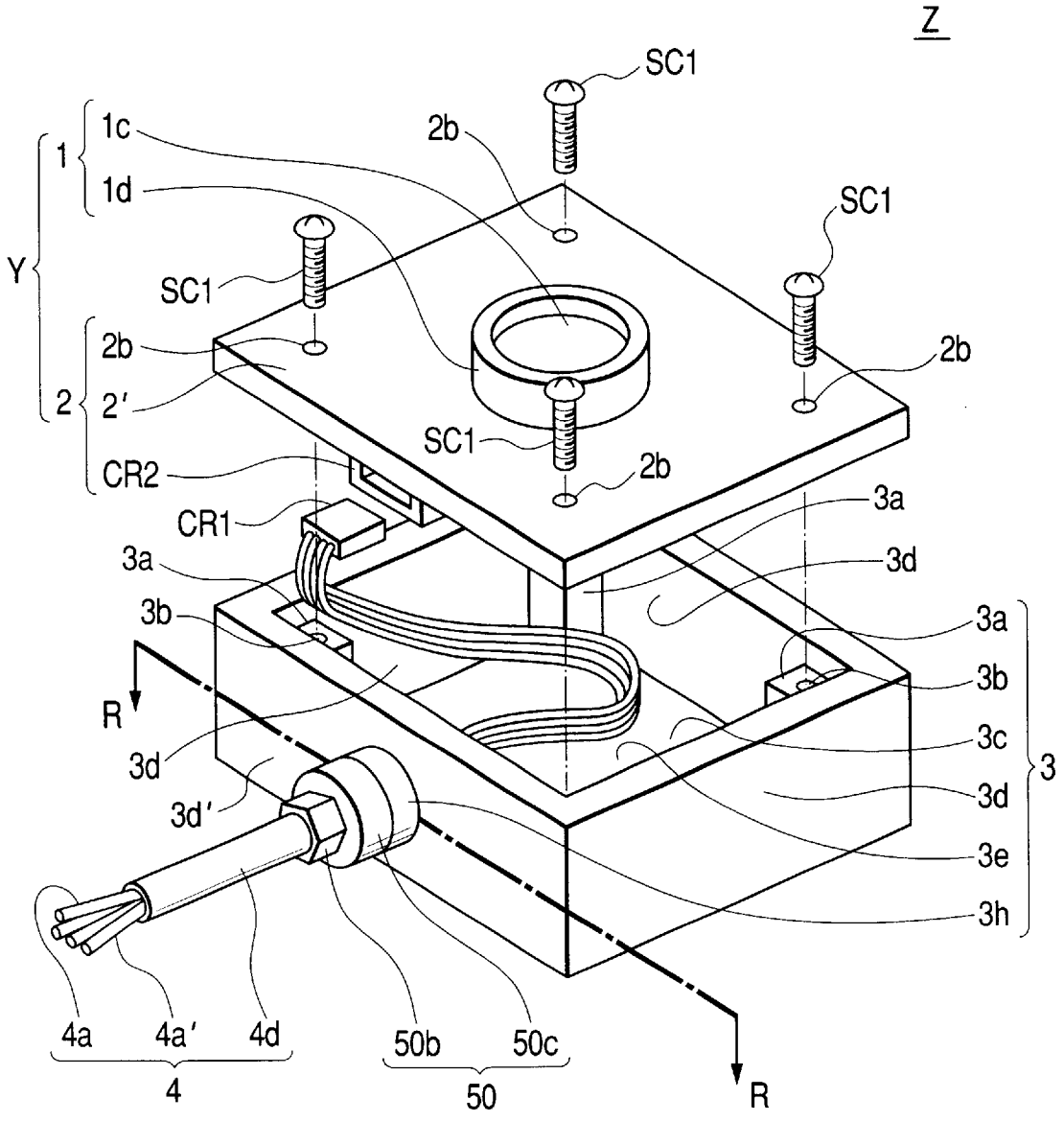
FIG. 8 is a perspective view of a conventional camera module which is in the process of being assembled.
Figure 9:
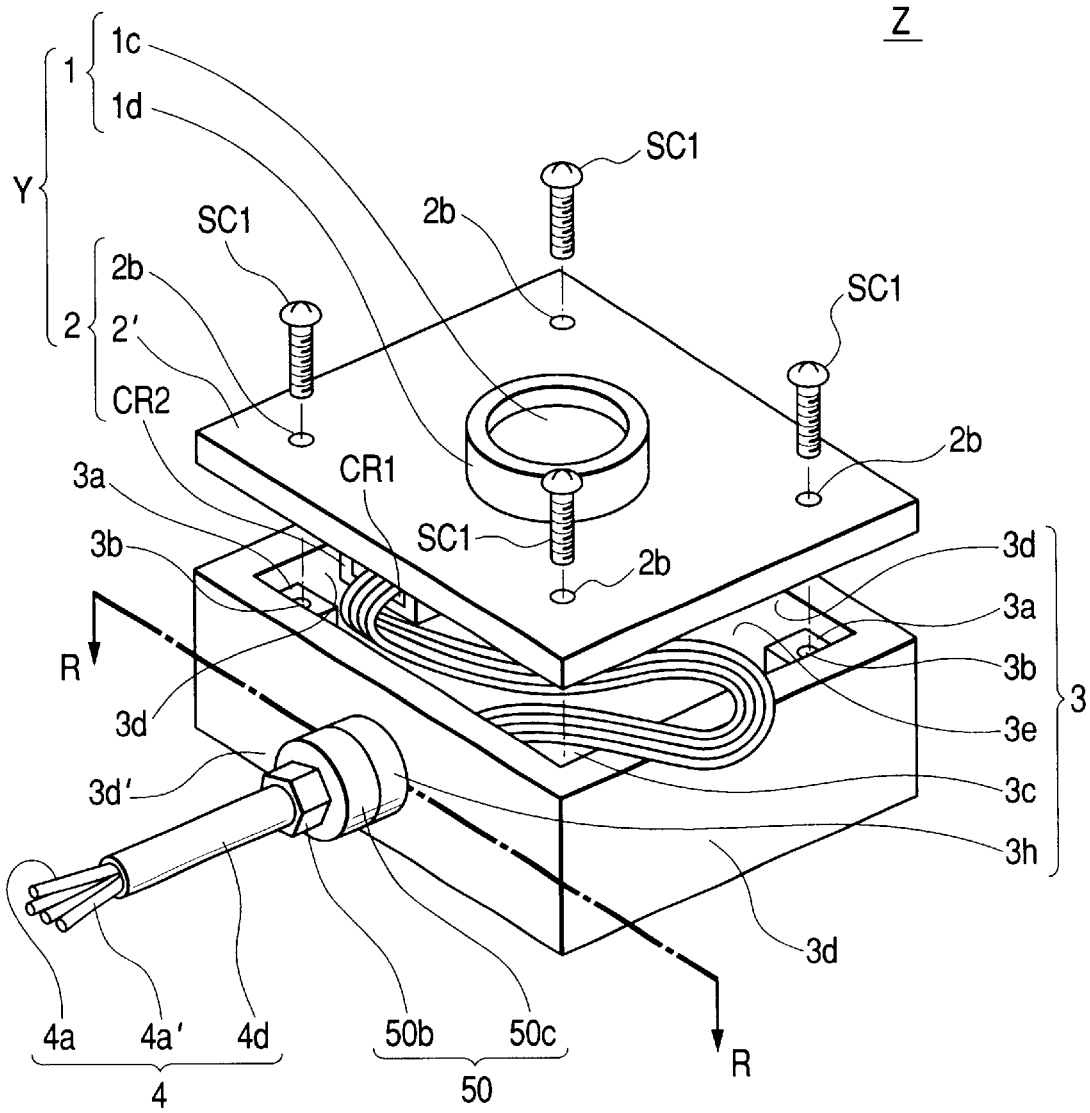
FIG. 9 is a perspective view specifically showing troubles encountered when mounting the camera module on a camera casing.
Figure 10:
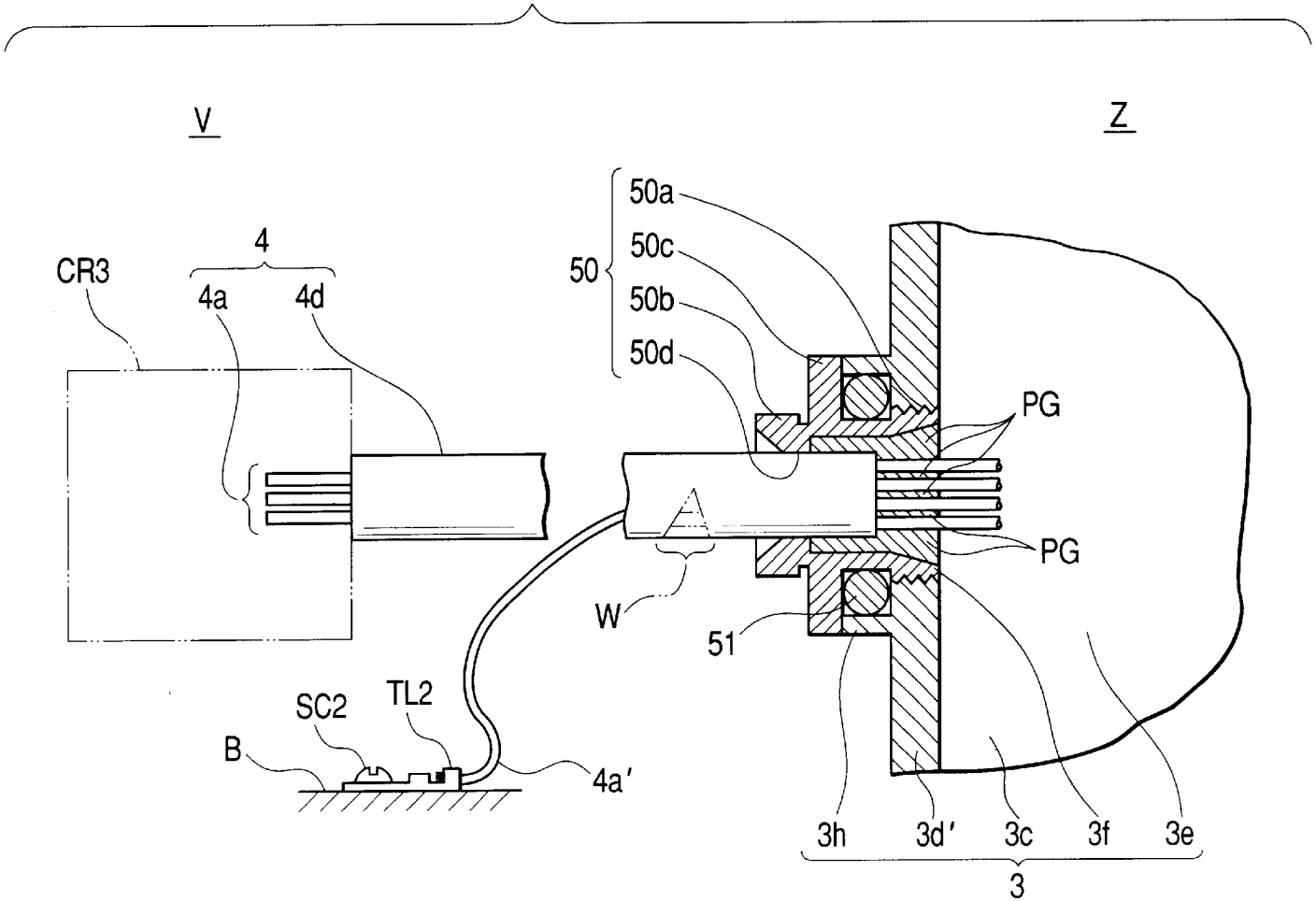
FIG. 10 is an enlarged, cross-sectional view taken along the line R—R of FIGS. 8 and 9, and also is a conceptual view showing an object to which a wire harness is connected.

In the conventional construction, the terminals or terminal members TL1 are secured respectively to the cables 4*a* and 4*a*' as shown in FIG. 7, and the clamp 50 is mounted on the wire harness 4, and the potting processing PG is applied, and the clamp 50, mounted on the wire harness 4, is threaded into the through hole 3*f* in the camera casing 3, and is mounted on this camera casing as shown in FIG. 10, and the terminals TL1 are received in the connector housing, thereby forming the connector CR1 as shown in FIG. 8, and this connector CR1 is connected to another connector CR2, comprising the connector housing which is formed on the board body 2' and receives the terminals therein, thus effecting the male-female connection of the connectors as shown in FIG. 9. The camera module Z must be assembled by these operations, and the cumbersome operations were involved when assembling and disassembling this camera module.

However, with the sealing structure of the camera module Z, the printed circuit board 2, which is provided with the camera 1, the connector main portion 31, formed by the male terminals 5 and the connector board 6, and the rubber plug 7 mounted on this connector main portion 31, that is, the camera module Y, is mounted on the camera casing 3, and by doing so, the connector 30 is formed at the camera module Z as shown in FIGS. 4 and 5. Therefore, when removing the wire harness 4 from the camera module Z, the camera module Z can be separated from the wire harness 4 without the need for disassembling the camera module Z, and there can be provided the camera module Z which is excellent in maintenance performance such as the handling.

In connection with the fact that the camera module Z can be easily assembled, the camera module Z can be easily disassembled, and therefore this structure is suited for recycling. Therefore, this contributes to the reduction of industrial wastes concerning the current problem of the global environment.

And besides, a defective product, which might be produced when assembling the conventional camera module Z of FIG. 9, can be eliminated. In the conventional construction, the cables 4*a* and the drain wire 4*a*' were, in some cases, caught between the board 2 and the camera casing 3 when mounting the board 2, having the camera 1 mounted thereon, on the camera casing 3, and in such a camera module Z, there was a fear that the conductors in the cable 4*a* or the drain wire 4*a*' were cut, and therefore it must be treated as a defective product.

However, it is not desirable to discard such semi-finished products from the viewpoint of the global environment, and besides this is wasteful from the viewpoint of production, and therefore it was necessary to re-assemble the camera module Z while changing the wire harness 4 (including the cables 4*a*, the drain wire 4*a*' and the tube 4*d*) and those parts relevant to the wires 4, such as the clamp 50. However, by adopting the present invention, such defective products can be eliminated without the need for much time and labor.

Furthermore, the sealing member, that is, the rubber plug 7, which maintains the sealed condition of the interior of the camera casing 3, is provided in the inner housing 32 of the camera casing 3, and therefore foreign matters, such as moisture, dust and dirt, will not intrude into the interior of the camera casing 3 from the exterior through the connector frontage portion 30*a*, so that a trouble can be prevented from developing in the camera module Z.

In the conventional camera module Z shown in FIGS. 8 and 9, the interiors of the connectors CR1 and CR2 were not sealed, and therefore when moisture or the like intruded into the interiors of the connectors CR1 and CR2, the moisture intruded to the printed circuit board 2 via the connectors CR1 and CR2, and there was a fear that this adversely affected the camera module Z.

However, by the use of the sealing structure of the camera module Z of the invention, foreign matters, such as moisture, dust and dirt, will not intrude into the interior of the camera module Z through the connector 30 formed at the camera module Z, and therefore any trouble will not develop in the camera module Z, and the stable operation of the camera module Z can be maintained for a long period of time.

It is not necessary to provide the complicated sealing structure in order to enhance the sealing performance, and therefore the number of the component parts will not increase, and there can be provided the camera module Z having the simplified assembling structure, and besides the sealed condition of the interior of the camera casing 3 can be kept good. Therefore, the cost of the camera module Z is reduced, and besides the sealing operation of the camera module Z can be carried out easily and rapidly.

The camera module Z of the invention can be easily assembled in the assembling process, and can be easily disassembled. Therefore, for example, even when the rubber plug 7, provided in the inner housing 32 within the receiving chamber 3*e* of the camera casing 3, is subjected to aged deterioration, and hence need to be exchanged, the disassembling, repairing, exchanging and assembling operations can be rapidly carried out so as to apply a suitable treatment to the defective portion.

The camera 1 is sealed by the camera casing 3 and the rubber plug 7, and when the cover 10 is attached to the camera casing 3, the camera 1 is kept in an air-tight condition, and therefore depending on the installation environment, the mating connector 8, mounted on the wire harness 4, can be of the non-waterproof type, and a general-purpose connector of the standard type can be used as the mating connector 8 adapted to be connected to the camera module Z. And besides, the control man-hour and the cost can be reduced by providing the parts for common use or the common parts.

With respect to the sealing structure of the camera module Z of the invention, detailed description will be made of the condition in which the rubber plug 7 is mounted on the connector main portion 31 formed by the male terminals 5 and the connector board 6.

As shown in FIG. 5, the round pin-shaped male terminals 5 project generally perpendicularly from the rear surface 6*c* of the connector board 6 toward the opening 30*b* of the connector frontage portion 30*a* formed at the camera casing 3. The insertion holes 7*g* of a cylindrical shape are formed through the rubber plug 7 in corresponding relation to the round pin-shaped male terminals 5, and extend from the front surface 7*a* of the rubber plug 7 to the rear surface 7*c* thereof.

The eight male terminals 5 are press-fitted respectively into the eight insertion holes 7*g* formed in the rubber plug 7, and part of the support shank portion 5*c* of each male terminal 5 projects outwardly from the insertion hole 7*g* in the rubber plug 7, and the front surface 7*a* of the rubber plug 7 and the ridge-shaped lip 7*d* of an annular shape (having no end), formed on the front surface 7*a* of the rubber plug 7, are held in intimate contact with the rear surface 6*c* of the connector board 6. In this manner, the rubber plug 7 is mounted on the connector main portion 31.

With this construction, when mounting the rubber plug 7 on the connector main portion 31 formed by the male terminals 5 and the connector board 6, the round pin-shaped male terminals 5, provided at the connector main portion 31, are aligned respectively with the cylindrical insertion holes 7*g* in the rubber plug 7, and are press-fitted respectively into the insertion holes 7*g* in the rubber plug 7, and the rubber plug 7 is pressed against the connector board 6 of the connector main portion 31, and as a result each of the male terminals 5, extending outwardly from the rubber plug 7, can be easily and positively sealed at its intermediate portion, that is, at that portion thereof extending between a generally middle point of the support shank portion 5*c* and the rear surface 6*c* of the connector board 6.

The relation between the diameter of the support shank portion 5*c* of the round pin-shaped male terminal 5 and the inner diameter of the insertion hole 7*g* formed in the first sealing member 7 will be described. In the embodiment of the invention, for example, the inner diameter of the insertion hole 7*g* in the first sealing member 7 is smaller than the diameter of the support shank portion 5*c* of the round pin-shaped male terminal 5 by an amount of about 1/10 to about 2/10 of the diameter of this support shank portion 5*c*. If a smaller-diameter portion, smaller than the inner diameter of the insertion hole 7*g*, is formed within the insertion hole 7*g*, this is preferable since the sealing performance is enhanced.

With this construction, the support shank portion 5*c* of each round pin-shaped male terminal 5 is positively press-fitted into the insertion hole 7*g* in the first sealing member 7, and therefore there is no fear that foreign matters, such as moisture, dirt and dust, intrude from the rear surface 7*c* to front surface 7*a* of the first sealing member 7 through that portion surrounding the round pin-shaped male terminal 5.

When the support shank portion 5*c* of each round pin-shape male terminal 5 and the cylindrical insertion hole 7*f* in the first sealing member 7 are used in combination, the male terminal 5 and the first sealing member 7 are satisfactorily sealed. For example, if male terminals of a rectangular shape and a rubber plug, having insertion holes of a rectangular shape corresponding to the shape of the male terminal, are used in combination, corner portions exist at the intimate contact area of the sealed portion, and therefore it is possible that foreign matters, such as moisture, dirt and dust, intrude into the rubber plug through these corner portions.

However, when the round pin-shaped male terminals 5 and the first sealing member 7, having the insertion holes 7*g* of a cylindrical shape corresponding to the shape of the male terminal, are used in combination, the cylindrical portions of the male terminal and the insertion hole are held in intimate contact with each other to achieve the sealing, and therefore any corner portion does not exist, and the male terminals 5 and the rubber plug 7 are sealed satisfactorily, and it is expected that the sealing performance is enhanced.

The mating connector 8 for fitting into the connector 30, formed at the camera module Z, will be described. The mating connector 8 mainly comprises a connector housing 8', formed by a front surface portion 8*a*, a rear end portion 8*b* and side walls 8*c* and 8*d*, a receiving chamber, and female terminals mounted within the receiving chamber. A terminal-side opening 8*e* is formed in the front surface portion 8*a* of the mating connector 8 so that the female terminals, provided within the receiving chamber of the connector housing 8' of the mating connector 8, can be electrically connected respectively to the male terminals 5 of the connector 30 formed at the camera module Z.

Each of the four corners of the box-shaped connector housing 8' of the mating connector 8, formed by the four side walls 8*c* and 8*d*, is formed by a gently-curved surface in corresponding relation to a waterproof plug 9' adapted to be press-fitted into a wire-side opening 8*f* in the connector housing 8' of the mating connector 8. Thus, the curved surfaces are formed respectively at the four corners of the box-shaped connector housing 8' of the mating connector 8, and therefore a stable seal is maintained between the mating connector 8 and the waterproof plug 9'.

The wire-side opening 8*f* for passing the wires 4 (such as the cables 4*a* and 4*a'* or the wire harness 4) therethrough is formed at that end of the mating connector 8 remote from the terminal-side opening 8*e*. The wires 4, such as the cables 4*a* and 4*a'*, are passed through this wire-side opening 8*f*. Those portions of the cables 4*a* and drain wire 4*a'*, extending from an end portion of a tape 4*d'* wound on the wire harness 4, are extended forwardly through the waterproof plug 9'.

Conductors and insulating sheaths of the cables 4*a* and drain wire 4*a'*, forwardly extending through the waterproof plug 9', are press-clamped by respective wire connection portions (that is, a conductor clamping piece portion and a sheath clamping piece portion) of the predetermined female terminals, and thus the cables 4*a* and 4*a'* are fixed and connected to the wire connection portions of the female terminals. The wire harness 4 may be formed into a bundled condition by a waterproof tube, and there is no problem even if the wire harness 4 is of any type.

One example of modified mating connectors of other shapes will be described. Instead of the connector housing 8' of the mating connector 8 shown in FIG. 1, for example, the wire-side opening 8*f*, formed in the rear end portion 8*b* of the connector housing of the mating connector 8, is formed into a wire-side opening of a circular shape corresponding to the cross-sectional shape of the wire harness 4, and the rear end portion of the connector housing of the mating connector is gradually tapering from a rectangular box-shape (defined by the four side walls 8*c* and 8*d*) into the circular shape of the circular wire-side opening. A general-purpose standard-type connector or a non-waterproof connector may be used as the mating connector, and in the invention, a connector of any shape and type can be used as the mating connector.

The female terminals, connected respectively to the cables 4*a* and 4*a'* of the wire harness 4, are inserted into predetermined terminal receiving chambers within the mating connector 8, and are easily, rapidly and positively fixed by retaining lances or the like provided in the terminal receiving chambers within the mating connector 8. The term "lance" means something like a spear, and the retaining lance is not limited to a spear-like shape, but may have any other suitable shape such as an arm-like shape.

With respect to terminals to be connected to the wires 4*a* and 4*a'* such as the cables 4*a* and 4*a'*, here, a press-clamping terminal will be described. The press-clamping terminal is the type of terminal having barrels which are plastically deformed to be mechanically and electrically connected to a wire by the use of a press-clamping tool or the like. Generally, the terminal includes a wire barrel, that is, a conductor-clamping piece portion for press-clamping a conductor portion from which an insulating sheath of the wire is removed, and an insulation barrel, that is, a sheath-clamping piece portion for press-clamping an insulating sheath of the wire. The wire barrels are classified into a closed barrel type and an open barrel type.

A female terminal is a mating terminal for a male terminal, and is adapted to receive the male terminal therein to be electrically connected to this male terminal, and there is known the type of female terminal having a resilient contact piece portion, such as a spring, for producing a contact load. The female terminals, used in the embodiment of the invention, have a generally cylindrical shape corresponding to the shape of the round pin-shaped male terminal 5, and have a resilient contact piece portion provided therein. Other terminals than such a generally-cylindrical female terminal can be used, and one example is a box-shaped female terminal having a generally tubular shape corresponding to the shape of a tab-type or a square pin-type male terminal, and any kind of female terminal can be used as the female terminals connected to the accessory module of the invention.

As shown in FIGS. 1 and 3, the waterproof plug 9' (which is a kind of sealing member 9'), made of rubber, is press-fitted in the wire-side opening 8*f* formed in the rear end portion 8*b* of the connector housing 8' of the mating connector 8. This waterproof plug 9' is a sealing member in the form of a hexahedron of a generally rectangular parallelepiped shape having a front surface of a generally rectangular shape, a rear surface of a generally rectangular shape, and four side surfaces (forming a peripheral surface) interconnecting the front and rear surfaces.

Each of four corners of the peripheral surface (formed by the four side surfaces) of the waterproof plug 9' of a generally rectangular parallelepiped shape is formed into a gently-curved surface so that this waterproof plug 9' can be press-fitted into the wire-side opening 8*f* in the rear end portion 8*b* of the connector housing 8' of the mating connector 8 so as to achieve a good sealing performance. Thus, the waterproof plug 9' has the shape similar to the shape of the receiving chamber in the box-like mating connector 8 of a generally rectangular shape, and therefore the sealing performance is enhanced.

Preferably, a lip, comprising at least one ridge of a rectangular annular shape (having no end), is formed on the rectangular peripheral surface (formed by the four side surfaces) of the waterproof plug 9' of a generally rectangular parallelepiped shape over the entire periphery thereof, and with this construction the sealing performance is further enhanced. The rectangular peripheral surface of the waterproof plug 9', including the lip, is held in intimate contact with the inner surface of the receiving chamber of the connector housing 8' of the mating connector 8, and is slightly squeezed, thereby producing a restoring force, so that a positive seal is formed between the waterproof plug 9' and the connector housing 8' of the mating connector 8.

The waterproof plug 9' is press-fitted in the connector housing 8' of the mating connector 8 in such a manner that the rear end surface of the waterproof plug 9' is disposed generally flush with the end surface of the rear end portion 8*b* of the connector housing 8' of the mating connector 8.

The waterproof plug 9', which is the separate member adapted to be press-fitted into the receiving chamber of the mating connector 8, may be replaced by one which is formed integrally with the mating connector 8. For example, the female terminals, connected to the cables 4*a* and 4*a'* by press-clamping, are beforehand inserted into the receiving chamber of the mating connector 8, and then a rubber material is poured into the predetermined receiving chamber of the mating connector 8, and is solidified, thereby forming the waterproof plug 9' formed integrally with the mating connector 8. Although the waterproof plug 9', as well as the connector housing 8' of the mating connector 8, has a rectangular shape as seen from the rear side, they may have any other shape such as a circular shape.

The diameter of each of insertion holes in the waterproof plug 9' is equal to the diameter of each of the cables 4*a* and 4*a'*, or is smaller than the diameter of the cable 4*a*, 4*a'* so that the outer peripheral surface of the cable 4*a*, 4*a'* can be held in intimate contact with the inner peripheral surface of the insertion hole. For example, in the embodiment of the invention, the inner diameter of each insertion hole of a cylindrical shape, formed in the waterproof plug 9', is smaller than the diameter of the cross-sectionally circular cable 4*a*, 4*a'* by an amount of about 1/10 to about 2/10 of the diameter of the cable. If a smaller-diameter portion, smaller than the inner diameter of the cylindrical insertion hole, is formed within the insertion hole, this is preferable since the sealing performance is enhanced.

With this construction, a suitable tightening force is produced between each insertion hole in the waterproof plug 9' and the cable 4*a*, 4*a'*, so that a positive seal is formed between the waterproof plug 9' and the cables 4*a* and 4*a'*. Therefore, foreign matters, such as moisture, dirt and dust, will not intrude into the receiving chamber of the mating connector 8 from that portion around the waterproof plug 9', and it is expected that the stable performance of the mating connector 8 is maintained for a long period of time.

There may be used an arrangement in which waterproof plugs of a cylindrical shape, made of rubber, are mounted on the cables 4*a* and 4*a'*, respectively, and are press-clamped together with the respective cables 4*a* and 4*a'* at the region including the wire connection portion of each female terminal (to which the cable 4*a*, 4*a'* is press-clamped), that is, at the region covering the sheath clamping piece portion and that portion of the cable 4*a*, 4*a'* disposed adjacent to the terminal. In this manner, the interior of the receiving chamber of the mating connector 8 may be sealed.

In addition to the above-mentioned waterproof plug 9', the rubber seal element 9 is provided at the front end portion of the mating connector 8 as shown in FIG. 1, and with this construction the mating connector 8 can be formed into a waterproof connector, and there can be provided the structure of connecting the accessory module Z and the wires 4 together, in which the stable performance is maintained over a long period of time even when it is used in an outdoor environment.

The lock arm 20 is formed integrally on the side wall 8*c* of the connector housing 8' (made of a resin) forming the mating 20 connector 8, and this lock arm is made of the same resin material as that of the mating connector 8. The lock arm 20 mainly includes a proximal end portion 21, an arm 22, and the operating portion 23. A base surface 22*a* of the arm 22 is disposed generally parallel to the outer surface of the side wall 8*c* on which this lock arm 20 is formed.

The distance between that surface of the arm 22, facing away from the base surface 22*a* (that is, that surface of the arm 22 which is a reverse side with respect to the base surface 22), and the side wall 8*c* of the connector housing 8' of the mating connector 8 is increasing gradually from the front end of the arm 22 toward the rear end thereof. The configuration of the arm 22 will be described more specifically, and the arm 22 extends in such a manner that the thickness of this arm 22 is decreasing gradually from its proximal end portion 21, disposed forwardly of the side wall 8*c* of the connector housing 8' of the mating connector 8, toward the rear operating portion 23. The lock arm 20 is formed in this manner.

Preferably, the arm 22 of the lock arm 20 has an inverted U-shaped cross-section (that is, a recessed configuration) over a region from the proximal end portion 21 to the operating portion 23 of the lock arm 20, and with this configuration the mechanical strength of the arm 22 is secured while reducing the cost of the material for the connector housing 81 of the mating connector 8.

The proximal end portion 21 of the lock arm 20 is provided immediately rearwardly of a mounting groove (in which the seal element 9 is fitted), formed in the front end of the mating connector 8, so that the proximal end portion 21 will not interfere with the seal element 9 mounted on the front end portion of the mating connector 8. The lock arm 20 extends from this proximal end portion 21 toward the rear end of the mating connector 8.

As seen from FIGS. 1 and 3, the retaining portion 25 for engagement in the engagement hole 35 (shown in FIGS. 1, 3 and 4) in the connector 30 of the camera module Z is provided on the arm 22 of the mating connector 8. The lock projection 25, serving as the retaining portion 25, is formed on a generally-central portion of the arm base surface 22*a* of the arm 22 shown in FIG. 1. The lock projection 25 includes the retaining surface 25*a*, a sliding contact surface 25*b*, a slanting sliding contact surface 25*c* and two side surfaces 25*d*.

The retaining surface 25*a* of the lock projection 25, formed o on the arm base surface 22*a* of the lock arm 20 is disposed generally perpendicular to this arm base surface 22*a*. The retaining surface 25*a* of the lock projection 25, shown in FIG. 1, corresponds to the engagement surface 35*a* of the engagement hole 35 formed in the connector 30 of the camera module Z shown in FIG. 4.

The pair of step portions 23*a*, corresponding to the rear end surface 34*c* of the connector housing 33 formed at the camera module Z, are formed on the front side of the operating portion 23 of the mating connector 8. When the mating connector 8 is inserted and fitted into the connector 30 of the camera module Z, the step portions 23*a* are brought into abutting engagement with the rear end surface 34*c* of the lock arm receiving portion 34 of the connector housing 33, thereby preventing the mating connector 8 from being excessively inserted into the connector 30 of the camera module Z. Thus, the step portions 23*a* serve also as stop walls. The retaining surface 25*a* of the lock projection 25, formed on the lock arm 22, is generally parallel to front surfaces of the pair of step portions 23*a* of the operating portion 23, and these surfaces play important roles in the retaining and engagement of the lock arm 20.

The operating portion 23 is in the form of a relief portion 23*b* of a U-shape or an inverted U-shape. Since the operating portion 23 has such a configuration, a cancellation operation for the lock arm 20 can be easily effected with the finger or a tool.

This relief portion 23*b* is needed in connection with the structure of a mold for injection molding the lock projection 25, and is provided in order to achieve a lightweight design of the mating connector 8 and to reduce the material cost of this connector. This relief portion 23 may have a through hole-shape to extend, for example, from the rear side of the operating portion 23 to the front side thereof.

As shown in FIGS. 1 and 3, a pair of projected portions 24, corresponding to the operating portion 23 of the lock arm 20, are formed on the side wall 8*c* of the connector housing 8' of the mating connector 8, and are spaced an equal distance from the centerline of the operating portion 23.

The pair of projected portions 24 are provided in the vicinity of the operating portion 23 of the lock arm 20, and therefore it is expected to somewhat prevent the following disadvantage. For example, when an object accidentally strikes against the mating connector 8, the operating portion 23 of the lock arm 20 is pressed hard, so that the retaining engagement (shown in FIG. 3) of the mating connector 8 with the connector 30 of the camera module Z is canceled, and the mating connector 8 is disengaged from the connector 30 of the camera module Z, and the electrical connection fails to be maintained. The pair of projected portions 24 serve also to protect the operating portion 23 of the lock arm 20.

As shown in FIG. 1, the seal element 9, made of nitrile rubber, which is in the form of a rubber O-ring, is fitted in the mounting groove formed in the front end of the connector housing 8' of the mating connector 8. Nitrile rubber is a rubber material which has excellent rubber elasticity, and is advantageous from the viewpoint of the cost. The rubber seal element 9 is a so-called endless ring of an annular shape having no end, and this annular member, when cut across its body, assumes a round transverse cross-sectional shape. With the use of the endless rubber seal element 9, the sealing performance of the relevant seal-forming portion is enhanced. The seal element 9 may have any other shape than the O-ring shape in so far as the sealing performance is not lowered.

The mounting groove, formed in the connector housing 8' of the mating connector 8 in corresponding relation to the rubber seal element 9 of the above shape, has an endless, annular shape, and has a generally rectangular cross-section. Each of four corners of this annular mounting groove is formed by a gently-curved portion or surface so that the good sealing performance of the rubber seal element 9, mounted in this groove, can be maintained.

The annular seal element 9 is fitted into the mounting groove, and this time this seal element 9, made of a rubber-like elastomeric material, is fitted thereinto while it is formed into a shape corresponding to the shape of this mounting groove. As a result, four curved portions 9*a*, each formed by a gently-curved line, are formed at the seal element 9. The seal element 9 (FIG. 1) of such a configuration is press-fitted into the inner housing 32 of the camera casing 3, shown in FIGS. 2 and 5, to achieve a sealing performance.

The seal element 9, shown in FIG. 1, has the shape corresponding to the rectangular shape of the inner housing 32 shown in FIGS. 2 and 5, and this sealing member is fitted in the mounting groove in the connector housing 8' of the mating connector 8. The seal element 9 is fitted in the mounting groove in the connector housing 8' of the mating connector 8 in such a manner that a suitable inwardly-directed tightening force is exerted on the annular seal 9 uniformly over the entire periphery thereof because of a restoring force of its rubber elasticity.

In order that the rubber seal element 9 can achieve the good sealing performance, the seal element 9 is mounted in the mounting groove in the connector housing 8' of the mating connector 8 in such a manner that a predetermined squeezing portion thereof projects outwardly from this mounting groove. Thus, the rubber seal element 9 is mounted in the mounting groove in such a manner that an outer peripheral surface 9*b* of the rubber seal element 9 projects outwardly from the outer surface of the connector housing 8' of the mating connector 8.

With this arrangement, when the mating connector 8 is inserted and fitted into the connector 30 of the camera module Z, the squeezing portion of the rubber seal element 9 is suitably squeezed, and produces a restoring force, and the outer peripheral surface 9*b* of the rubber seal element 9 is pressed against the inner peripheral surface 32*c* of the inner housing 32 provided within the receiving chamber 3*e* of the camera casing 3 shown in FIGS. 4 and 5. As a result, the rubber seal element 9 is held in good intimate contact with the inner housing 32 of the camera module Z, thereby sealing the connector 30.

The peripheral length of the outer peripheral surface 9*b* of the rubber seal element 9, fitted in the mounting groove in the connector housing 8' of the mating connector is larger than the peripheral length of the inner peripheral surface 32*c* of the inner housing 32 provided at the camera casing 3. With this construction, when the mating connector 8 is inserted and fitted into the connector 30 of the camera module Z, the squeezing portion of the rubber seal element 9 (fitted in the mounting groove in the mating connector), including the outer peripheral surface 9*b*, is suitably squeezed uniformly over the entire periphery thereof by the inner peripheral surface 32*c* of the inner housing 32 provided at the camera module Z. Thus, the outer peripheral surface 9*b* of the rubber seal element 9, fitted in the mounting groove in the connector housing 8' of the mating connector, is held in intimate contact with the inner peripheral surface 32*c* of the inner housing 32 of the camera module Z, so that a good seal is formed therebetween.

The relation between the diameter and squeezing amount of the sealing member (annular member) 9 of a round cross-section, here in the form of an O-ring, will be described briefly. Let's assume that the annular rubber seal element 9 is cut transversely by a knife or the like, so that opposed cut portions are formed. This imaginary cut portion is circular, and the diameter of this circular portion is called an imaginary cross-section diameter. In order to achieve the sealing performance, the squeezing amount is set to the range of from about 1/30 to about 1/3 of the diameter of this circular cross-section, that is, the imaginary cross-section diameter, and preferably about 1/10 of this diameter.

If the squeezing amount of the seal element 9 is less than 1/30 of the imaginary cross-section diameter of this seal element 9, the desired rubber elasticity is not properly produced even when the seal element 9 is squeezed by the relevant seal-forming member, and therefore the seal element 9 fails to be held in good intimate contact with the relevant seal-forming member, and the positive sealing properties can not be expected. If the squeezing amount of the seal element 9 is larger than 1/3 of the imaginary cross-section diameter of this seal element 9, there are fears that the seal element 9 is not properly squeezed by the relevant seal-forming member (mating member), so that the mounting operation and fitting operation are affected, and that the sealing member is plastically deformed, so that the sealing performance is lowered.

Description will be made of production methods and materials for the various sealing members, such as the rubber plug 7, the seal element 9, the waterproof plug 9' and the grommets, which play important roles in the sealing performance. The sealing member, such as the rubber plug 7, the seal element 9, the waterproof plug 9' and the grommet, is produced by a method in which a starting material of a synthetic polymer, such as high-speed granular silicone, is poured into a predetermined mold, and then is solidified into a predetermined shape, and thereafter a vulcanizing treatment is applied to the sealing member if necessary.

The vulcanizing treatment is a heat treatment for imparting rubber elasticity to the sealing member such as the rubber plug 7, the seal element 9, the waterproof plug 9' and the grommet, and when such a vulcanizing treatment is applied, the cross-linking is promoted in the rubber material, thereby imparting rubber elasticity to the sealing member, so that the sealing member, such as the rubber plug 7, the seal element 9, the waterproof plug 9' and the grommet, can produce a sufficient restoring force.

Examples of materials for the sealing member, such as the rubber plug 7, the seal element 9 and the waterproof plug 9', and the sealing member, serving also as a protective member, such as the grommet, include silicone rubber (abbreviation: PVMQ OR VMQ), ethylene propylene rubber (abbreviation: EPDM or EPM), nitrile rubber (abbreviation: NBR), styrene butadiene rubber (abbreviation: SBR), acrylic rubber (abbreviation: ACM or ANM), butyl rubber (abbreviation: IIR), urethane rubber (abbreviation: AU or EU), chloroprene rubber (abbreviation: CR), epichlorohydrin rubber (abbreviation: CHR or CHC), natural rubber (abbreviation NR) and fluororubber (abbreviation: FKM).

Various fillers may be added to the rubber material if necessary. Any material can be selected as the material for the various sealing members, used in the invention, depending on the purpose of use, such as the region where it is used. For example, the sealing member may be made of other material than the above-mentioned rubber materials, such as a metallic material, and an adhesive may be used as a starting material.

As shown in FIGS. 1 and 3, the wire harness 4 is mounted in the connector housing 8' of the mating connector 8 through the wire-side opening 8*f* of this connector housing, with the wire harness 4 extending rearwardly therefrom. Thus, the wire harness 4 is connected to the mating connector 8. The cables 4*a* and 4*a*' for electrical connection are combined together into a bundle by a waterproof tube or the like, thereby forming the wire harness 4.

The wire harness 4 will be described in detail, and as shown in FIG. 6, each of the cables 4*a* and 4*a*', forming the wire harness 4, comprises a plurality of conductors 4*b* and an insulating sheath 4*c*, and provides a conductor cable, and very small gaps 4*b*' are seen between the conductors 4*b*. The plurality of cables 4*a* and 4*a*', each comprising the flexible conductors 4*b* and insulating sheath 4*c* (shown in FIG. 6), are combined together into a bundle by a bundling tape 4*d*' (shown in FIGS. 1 and 3) or a flexible waterproof tube to form the wire harness 4. In use, the wire harness 4 is bent at required portions thereof.

The wire harness 4 are bent at required portions thereof in conformity with the configuration of an automobile, and is mounted on a predetermined portion of the automobile, and in this manner, electrical connection between parts and equipments of the automobile is made by this wire harness. In order that other electrical circuit can be additionally connected, In addition to the cables 4*a* and the drain wire 4*a*', a dummy wire may be provided in the wire harness 4, if necessary, so that other electrical circuit can be connected.

By the use of the wire harness 4, the camera module Z is electrically connected to an electrical part, such as a non-waterproof connector provided within the vehicle. The drain wire branches off from an intermediate portion of the wire harness 4, and a terminal is secured to one end of the drain wire, and the terminal is secured to a frame of a vehicle body by a screw or the like. The drain wire 4*a*' is thus secured to the vehicle body, and therefore the drain wire 4*a*' is electrically connected to the vehicle body to perform the function of an earth.

In use, the wire harness 4 is bent at the required portions, and therefore preferably, each conductor 4*b* comprises a flexible metal wire which has good electrical conductivity, and has such properties as to withstand the repeated bending. The cable 4*a*, 4*a*' comprises the plurality of conductors 4*b* which are bundled together and suitably twisted to provide the conductor cable having excellent strength. In order to enhance the insulating properties of the surface of the conductor 4*b* comprising the metal wire, the conductors 4*b*, each coated with an enamel material, may be used in the wires 4 such as the wire harness 4.

Preferably, the insulating sheath 4 or a tube, protecting the conductors 4*b*, is made of a flexible insulative material having such properties as to withstand the repeated bending as described above. Examples of such insulative material for the insulating sheath 4 or the tube of the cables 4*a* and 4*a*', forming the wire harness 4, include a synthetic resin material, a soft resin material, a rubber material, and a mixture of these materials. Various fillers may be added to the insulative material if necessary.

The grommets (not shown) may be mounted on the wire harness 4, shown in FIGS. 1 and 3 if necessary. Grommets (not shown) are mounted on the wire harness 4 intermediate the opposite ends thereof. When a wire, such as a wire harness, a tube, a hose and a cable, is passed through a through hole formed in a vehicle body or a casing of a part, the grommet prevents the wire from being damaged by an edge or a corner portion of the through hole, formed in the vehicle body or the casing of the part, and also prevents the inner conductors of the thus cut wire from being exposed, thereby preventing troubles such as short-circuiting and electrical leak. Thus, the grommet has the function of protecting the wire.

The grommet is an annular part made of rubber which also provide the waterproof, dust-insulating and sound-insulating effects. The grommets are used when passing a wire harness from a vehicle room to the exterior of the vehicle or when passing a wire harness from the vehicle room into an engine room or a trunk room. Examples of grommets include a pot-type grommet, bellows-type grommet, a laterally-projecting-type grommet and a bifurcated-type grommet.

The pot-type grommet is one which is usually mounted in a through hole portion formed in a vehicle body, and this grommet can be mounted on a dash panel or fender with a higher efficiency, and has a pot-like shape. The bellows-type grommet has a bellows shape, and has the function of absorbing the expansion and contraction of a wire such as a wire harness, and is used at a region where the expansion and contraction occurs, for example, upon opening and closing of a door. The laterally-projecting-type grommet is used in the case where a wire, such as a wire harness, interferes with other part at a region, including a through hole in a vehicle body and its neighboring portion, so that a path of installation of the wire, such as the wire harness, can not be smoothly made straight.

The bifurcated-type grommet is used in the case of branching a wire, such as a wire harness, at a region including a through hole and its neighboring portion. For example, a pot-type grommet or a bellows-type grommet is used in a through hole at an engine room, and the wire harness is divided into two sections, extending in different directions, immediately after this grommet. In this case, a wire-passing through hole in the grommet is spread by the wire harness divided into the two sections, and it is possible that water, intruding into the engine room through the spread wire-passing through hole in the grommet, further intrudes into a car room, thus causing water leakage. In order to prevent such a trouble, the grommet is bifurcated to provide two portions which extend respectively in directions of installing of the two separate sections of the wire harness, and this is the bifurcated-type grommet.

When the connector 30, formed at the camera module 3, is coupled to the mating connector 8, secured to the wire harness 4, in a male-female manner, and is electrically connected thereto, the connector 30 is sealed, and this condition will be described in detail.

As can be seen from FIGS. 1 and 4, the lip 7*f*, comprising one annular, endless ridge, is formed on the rear surface 7*c* of the rubber plug 7 provided at the connector 30 of the camera casing 3. As can be seen from FIG. 1, the annular, endless rubber seal element 9 is provided at the front end of the mating connector 8 secured to the wire harness 4.

As can be seen from FIG. 3, when the mating connector 8 and the connector 30 of the camera module Z are coupled together in a male-female manner, the two are electrically connected together. At this time, the front surface portion 8*a* of the connector housing 8' of the mating connector 8, shown in FIG. 1, is held in intimate contact with the rear surface 7*c* of the rubber plug 7 and the lip 7*f* (shown in FIGS. 4 and 5) formed on the rear surface 7*c* of the rubber plug 7. At the same time, the outer peripheral surface 9*b* of the rubber seal element 9 (shown in FIG. 1), provided on the mating connector 8, is held in intimate contact with the inner peripheral surface 32*c* of the inner housing 32, provided within the receiving chamber 3*e* of the camera casing 3 shown in FIGS. 4 and 5, so that the connector 30 is sealed.

With this construction, merely by connecting the mating connector 8, secured to the wire harness 4, to the connector 30 provided at the camera casing 3, the connector 30 is sealed, and therefore the connector 30 does not need to have a complicated, special sealing structure. Therefore, there can be provided the camera module Z in which the number of the component parts is not increased, and the cost is reduced, and the excellent sealing performance is achieved.

And besides, the fitting connection between the connector 30 of the camera casing 3 and the mating connector 8, secured to the wire harness 4, can be easily and rapidly effected and canceled. There can be provided the camera module Z in which the connectors, which can be coupled together in a male-female manner, can be easily electrically connected together and disconnected from each other.

As can be seen from FIG. 1, when the mating connector 8, secured to the wire harness 4, is fitted into the connector 30 formed at the camera module Z, the camera module Z and the wire harness 4 are electrically connected together as shown in FIG. 3. This electrical connection is effected, and also the mating connector 8 and the connector 30 can be easily, rapidly and positively coupled together and disconnected from each other, and besides the connected condition will not be easily canceled, and this condition will be described.

As shown in FIG. 1, the mating connector 8 begins to be inserted into the opening 30*b* in the connector frontage portion 30*a* of the camera module Z, with the front surface portion 8*a* first introduced thereinto, and also the lock arm 20 begins to be inserted into the lock arm receiving portion 34, provided at the connector frontage portion 30*a*, with the proximal end portion 31 of the lock arm 20 first introduced thereinto.

When the mating connector 30 is further inserted into the connector frontage portion 30*a* of the camera module Z, the slanting sliding contact surface 25*c* of the lock projection 25, formed on the lock arm 20 of the mating connector 8 shown in FIG. 1, is brought into abutting engagement with the lock arm receiving portion 34 provided at the connector frontage portion 30*a* of the camera module Z shown in FIGS. 1 and 4. More specifically, this slanting sliding contact surface is brought into abutting engagement with the corner portion where the inner surface of the side wall 34*a* (including the sliding contact surface 34*a*') of the lock arm receiving portion 34, provided at the connector frontage portion 30*a*, and the rear end surface 34*c* of the lock arm receiving portion 34 perpendicularly intersect each other.

When the mating connector 8 is inserted deeper into the mating connector-receiving chamber 33*b* of the connector frontage portion 30*a* provided at the camera module Z, the sliding contact surface 25*b* (shown in FIG. 1) of the lock projection 25, formed on the lock arm 20 of the mating connector 8, is brought into sliding contact with the sliding contact surface 34*a*' (shown in FIG. 4), formed by the inner surface of the side wall 34*a* of the lock arm receiving portion 34 formed at the connector housing 33 of the connector frontage portion 30*a* of the camera module Z. In this condition, the mating connector 8 continues to enter the mating connector-receiving chamber 33*b* formed in the connector 30 of the camera module Z.

At this time, the resin lock arm 20, formed at the mating connector 8, is elastically deformed in the process of retaining of this lock arm 20 by the engagement hole 35 formed in the connector housing 33 of the camera module Z. More specifically, the lock arm 20 is elastically deformed toward the side wall 8*c* of the connector housing 8' of the mating connector 8, on which this lock arm 20 is formed, in such a manner that a restoring force is produced at the proximal end portion 21 and its neighboring portion or over the entire length of the arm 22.

Then, the lock projection 25, formed on the lock arm 20 of the mating connector 8 shown in FIG. 1, slides past the sliding contact surface 34*a*' (shown in FIG. 4), formed by the inner surface of the side wall 34 of the lock arm receiving portion 34 provided at the connector frontage portion 30*a* of the camera module Z, and becomes fitted in the engagement hole 35 formed in the lock arm receiving portion 34.

At the same time, the elastically-deformed resin lock arm 20 is restored generally into its original condition, and thus the lock projection 25 (shown in FIG. 1), formed on the lock arm 20, is retainingly engaged in the engagement hole 35 (shown in FIG. 4) formed in the connector housing 33, and the retained condition is achieved as shown in FIG. 3.

More specifically, the elastically-deformed resin lock arm 20 is restored generally into its original posture by the restoring force inherently possessed by the lock arm 20, and the lock projection 25 is positively kept retained in the engagement hole 35 in such a manner that the retaining surface 25*a* (shown in FIG. 1) of the lock arm 25, formed on the lock arm 20 of the mating connector 8, is abutted against or opposed to the engagement surface 35*a* (shown in FIG. 4) of the engagement hole 35 formed in the lock arm receiving portion 34 of the connector frontage portion 30*a* of the camera module Z.

At this time, the arm base surface 22*a* (shown in FIG. 1) of the lock arm 20, formed on the mating connector 8, and the inner surface of the side wall 34*a* (shown in FIG. 4) of the lock arm receiving portion 34, including the sliding contact surface 34*a*', are abutted against each other or are closely spaced from each other in generally-parallel, opposed relation to each other.

The connector 30 of the camera module Z and the mating connector 8 are coupled together in a male-female manner in this condition, and therefore for example, when the wire harness 4, shown in FIG. 3, is accidentally pulled rearwardly, the mating connector 8, secured to the wire harness 4, will not be withdrawn from the connector 30 of the camera module Z, thereby preventing the camera module Z and the wire harness 4 from being electrically disconnected from each other.

And besides, as shown in FIG. 3, the front surfaces of the pair of step portions 23*a*, formed at the front side of the operating portion 23 formed on the lock arm 20 on the mating connector 8, are disposed in closely-spaced, opposed relation to the rear end surface 34*c* of the lock arm receiving portion 34, provided at the connector housing 33 of the camera module Z, so that these front surfaces of the step portions 23*a* can immediately abut against the rear end surface 34*c*.

Thus, the mating connector 8 and the connector 30 of the camera module Z can be coupled together in a male-female manner, utilizing the step portions 23*a* formed at the front side of the operating portion 23 of the lock arm 20, and with this construction it is expected that the operation can be effected with a good feeling when retaining the two relative to each other and when canceling the retained condition of the two, and besides it is expected that the retained condition of the two can be maintained in a more stable manner.

There is a possibility that the mating connector 8 is excessively pushed into the connector 30 of the camera module Z, for example, when connecting the mating connector 8 to the connector 30 of the camera module Z or when other object accidentally strikes against the mating connector 8.

However, the front surfaces of the pair of step portions 23*a*, formed at the front side of the operating portion 23 formed on the lock arm 20 on the mating connector 8, are disposed in closely-spaced, opposed relation to the rear end surface 34*c* of the lock arm receiving portion 34, provided at the connector housing 33 of the camera module Z, so that these front surfaces of the step portions 23*a* can immediately abut against the rear end surface 34*c*. Therefore, the mating connector 8 will not be excessively inserted deep into the connector 30 of the camera module Z. Therefore, it is expected that the male and female connectors can be connected together with a good attaching feeling.

The mating connector will not be excessively inserted deep into the connector 30 of the camera module Z, and therefore there is no fear that the connector 30 of the camera module Z and its neighboring portions, as well as the parts within the camera casing 3, disposed adjacent to this connector, are damaged, and there is no fear that the misalignment of the parts is caused by such excessive pushing. Furthermore, there is no fear that the mating connector 8 is damaged, and it is expected that troubles, such as damage and misalignment, are prevented from developing in the camera module Z and the mating connector 8.

As described above, the retaining portion 25 of the above shape and the engagement portion 35 of the above shape, are provided respectively at the male and female connectors, and therefore the retaining can be effected in a positive and stable manner, and when the male and female connectors are connected together, this male-female connection can be carried out with a good feeling in such a manner that it can be confirmed that the positive retaining is effected. When the connected condition of the male and female connectors is canceled, this canceling operation can also be carried out with a good feeling.

The dimensions of the various portions are so determined that in the above retained/engaged condition, the front surface portion 8*a* (shown in FIG. 1) of the connector housing 8' of the mating connector 8 is pressed against the rear surface 7*c* of the rubber plug 7 and the lip 7*f* (shown in FIGS. 4 and 5), formed on the rear surface 7*c* of the rubber plug 7, and therefore is held in intimate contact therewith.

For removing the mating connector 8, secured to the wire harness 4, from the camera module Z shown in FIG. 3, the locked condition of the lock arm 20 on the mating connector 8 is canceled, and the mating connector 8, secured to the wire harness 4, is withdrawn from the camera module Z. More specifically, the operating portion 23 of the resin lock arm 20 is sufficiently pressed toward the side wall 8*c* of the connector housing 8' of the mating connector 8 with the finger or other means, and by doing so, the resin lock arm 20 is elastically deformed toward the side wall 8*c* of the connector housing 8*c* of the mating connector 8.

As a result, the retaining surface 25*a* (shown in FIG. 1) of the lock arm 25 (formed on the lock arm 20 on the mating connector), which is abutted against or opposed to the engagement surface 35*a* (shown in FIG. 4) of the engagement hole 35 formed in the lock arm receiving portion 34 of the connector housing 33 of the camera module Z, is brought out of registry with this engagement surface 35*a*. While maintaining this condition, the mating connector 8, secured to the wire harness 4, is withdrawn from the connector 30 of the camera module Z, and by doing so, the camera module Z and the wire harness 4 can be easily and rapidly disconnected from each other.

The positional relation between the retaining portion 25 and the engagement portion 35 may be reversed with respect to the connector 30 of the camera module Z and the mating connector 8. The positional relation between the male terminals and the female terminals, as well as the positional relation between the male connector and the female connector, may be reversed.

The cover 10 will be described, and the cover 10 is formed by a front wall 10*c* and side walls 10*d* provided respectively at four sides of this front wall 10*c* in surrounding relation thereto, so that a receiving chamber 10*e* is formed. A rectangular window 10*f* for securing a field of vision of the camera 1 is formed in the front wall 10*c* of the cover 10. If a plate of a resin, such as a clear, transparent acrylic resin, or a plate of clear, transparent glass is mounted in this window 10*f*, there can be o provided the camera module Z which is excellent in air-tightness while securing the field of vision of the camera 1. Depending on the purpose of use, the window 10*f* in the cover 10 may not be provided if it is not necessary.

The fixing portions 10*a* and mounting holes 10*b*, corresponding to the flange-like fixing portions 3*a*' and mounting holes 3*b*' provided at the four corner portions of the front surface of the camera casing 3, are provided at the four corner portions of the cover 10. The mating surface 10*g* (defined by a flat surface), corresponding to the mating surface 3*g* (defined by a flat surface) formed at the front ends of the side walls 3*d* of the camera casing 3, is formed at the ends of the side walls 10*d* of the cover 10, so that when the cover 10 is attached to the camera casing 3, the camera module Y can be sealingly isolated from the exterior.

With respect to the sealing structure of the camera module Z of the invention, description will be made of the condition in which the camera 1 is sealed by the camera casing 3 and the cover 10.

When the cover 10 is attached to the camera casing 3, the mating surface 3*g* of the camera casing 3 is abutted with the mating surface 10*g* of the cover 10, and the camera 1 is sealed within the receiving chamber 3*e* of the camera casing 3 or the receiving chamber 10*e* of the cover 10. With this construction, the camera 1 is positively sealed by the camera casing 3 and the cover 10, and therefore foreign matters, such as moisture, dirt and dust, will not intrude into the interior of the camera module Z from the exterior, and troubles can be positively prevented from developing in the camera module Z.

Instead of merely abutting the mating surface 3*g* of the camera casing 3 and the mating surface 10*g* of the cover 10 with each other, a sealing member, such as a seal element, a packing or an adhesive, may be interposed between the two abutted mating surfaces 3*g* and 10*g*, with no gap formed therebetween, in which case a more positive seal is formed between the mating surfaces 3*g* and 10*g* of the camera casing 3 and the cover 10.

Preferably, the camera casing 3, the inner housing 32, the connector housing 33, the connector board 6, the connector housing 8' of the mating connector 8, the cover 10 and so on are formed by injection molding, using a synthetic resin. If these parts are produced by a synthetic resin which has injection moldability and a thermoplastic nature, the excellent mass productivity is achieved, and therefore the productivity is enhanced, and this is efficient. However, these parts may be produced by other molding method than the injection molding method, depending on their shape.

Particularly if the camera casing 3, on which the inner housing 32 and the connector housing 33 are integrally molded, the connector housing 8' of the mating connector 8, on which the lock arm 20 and the retaining lances are integrally molded, and the connector board 6, in which the male terminals 5 are integrally molded, are formed by a synthetic resin which has injection moldability and a thermoplastic nature, even the molded parts of a complicated shape can be easily and rapidly produced in a large amount.

The molded parts, made of the above synthetic resin, inherently possess a suitable degree of restoring elastic force, and therefore it is effective to form the connector housing 8' of the mating connector 8, on which the lock arm 20 and the retaining lances are integrally formed, by the use of the above synthetic resin.

If the connector housing 8' of the mating connector 8, on which the lock arm 20 is integrally formed, is made of the above synthetic resin, the lock arm 20, made of the synthetic resin, can be easily elastically deformed at the proximal end portion 21 and its neighboring portion or over the entire length of the arm 22 when connecting the two connectors together in a male-female manner while engaging the retaining portion 25 (FIG. 1), formed on the lock arm 20 of the mating connector 8, in the engagement portion 35 (FIG. 4) formed in the connector housing 33 of the camera module Z as described above.

The lock arm 20, made of the synthetic resin, is suitably elastically deformed, and then the retaining portion 25 is easily brought into engagement with the engagement portion 35, and then the lock arm 20, made of the synthetic resin, is restored from the elastically-deformed condition generally into its original posture because of a suitable degree of its inherent restoring elastic force.

This retained condition can be canceled by intentionally elastically deforming the lock arm 20 of the synthetic resin sufficiently. Therefore, the connector 30, formed at the accessory module Z, such as the camera module Z, and the mating connector 8, secured to the wires 4, such as the wire harness 4, can be rapidly and easily connected together and disconnected from each other.

The resin-made retaining lances (not shown) for properly fixing the female terminals are provided within the terminal receiving chambers of the connector housing 8' of the mating connector 8. When the female terminal is mounted in the terminal receiving chamber of the connector housing 8' of the mating connector 8, the retaining lance serves to fix this terminal easily, rapidly and positively. These retaining lances are also required to have elastic properties, and therefore it is effective to form the connector housing 8' of the mating connector 8 by the above synthetic resin.

Examples of such synthetic resins, which has injection moldability and a thermoplastic nature, include polybutylene terephthalate resin (abbreviation: PBT), an acrylonitrile-butadiene-styrene resin (abbreviation: ABS), a polyamide resin (abbreviation: PA) and a polypropylene resin (abbreviation: PP). Various fillers may be added to the synthetic resin if necessary.

In the embodiment of the invention, the camera casing 3, on which the inner housing 32 and the connector housing 33 are integrally formed, the connector board 6, in which the male terminals 5 are integrally molded, and the connector housing 8' of the mating connector 8, on which the lock arm 20 and the retaining lances are integrally formed, are made of a polybutylene terephthalate resin (PBT), and are excellent in dimensional stability, strength stability, electrical characteristics and so on. One example of the polybutylene terephthalate resin (PBT) is PBT-HO1.

As shown in FIGS. 1 to 5, the corner portions of the camera 1, printed circuit board 2, camera casing 3, connector board 6, rubber plug 7, connector housing 8' of the mating connector 8 and cover 10 are chamfered if necessary. "Chamfering" means a condition in which a corner, at which two surfaces intersect each other, is formed into a slanting surface or a rounded shape. C-chamfering is a slanting surface-shape chamfering, and R-chamfering is a rounded-shape chamfering. The purposes of such chamfering are to prevent stresses from concentrating on a corner portion and to prevent an accident such as the wounding of the hand by a corner portion.

With respect to methods of producing the accessory modules Y and Z, such as the camera modules Y and Z, methods of producing the component parts of the camera modules Y and Z, a procedure of assembling these parts to form the camera modules Y and Z, and assembling methods will be described with reference to FIGS. 1 to 6.

The camera 1 (shown in FIGS. 1, 2 and 5), including the fixing portions 1*a*, the mounting holes 1*b*, the lens 1*c*, the lens periphery portion 1*d* and the camera body 1', is beforehand prepared.

The board 2, shown in FIGS. 1, 2 and 5, is molded of a thermosetting resin, and the circuit conductors, made of a metal foil such as a copper foil, are formed on the board body 2' by printing or the like, and then an insulating coating is formed on the circuit conductors, thereby forming the printed circuit board. The various electrical circuits (not shown), such as relays, fuses, capacitors, semiconductors, terminals, bus bars, connectors and wires, are mounted on this printed circuit board 2, and are electrically connected to the circuit conductors on the board body 2'.

The terminals (such as the male terminals 5, shown in FIGS. 1, 2 and 5, and the female terminals corresponding to these male terminals) and the various bus bars are produced by pressing (blanking and bending) metal wires (such as steel wires) and metal terminal blanks into the respective predetermined shapes.

One example of the method of producing the round pin-shaped male terminal 5 will be specifically described. A steel wire is cut into a predetermined length, and then pressing and bending operations are applied to the steel wire, so that the proximal bent portion 5*a*, the projected portion 5*b*, the support shank portion 5*c* and the distal end portion 5*d* are formed. In order to enhance the precision of the diameter of the support shank portion 5*c* of the round pin-shaped male terminal 5, the steel wire may be one subjected to squeezing.

In such a processing method, a long, continuous metal wire (for example, a steel wire) is set, for example, in an inlet of a pressing machine, and is processed by the pressing machine while it is fed in a sequential manner. For example, each time the steel wire is fed one stroke, the squeezing, the cutting and the bending/pressing of the steel wire are effected sequentially. The male terminal 5 of the predetermined shape is produced and obtained at an outlet of the pressing machine. By carrying out the above production method by the use of such a pressing machine, the male terminals 5 of the predetermined shape can be produced efficiently and rapidly.

In the injection molding of the connector board 6, the round pin-shaped male terminals 5 are beforehand set in a cavity of an injection mold, and then a synthetic resin is poured into the cavity of the injection mold, so that the male terminals 5 are insert molded in the connector board 6. Thus, the connector board 6 is injection molded, with the male terminals 5 molded therein, thereby producing the connector main portion 31.

A method of producing the rubber-like elastomeric members (such as the rubber plug 7, the seal element 9, the waterproof plug 9' and the grommets) will be described. A synthetic polymer, such as high-speed granular silicone, is poured into a predetermined mold, and then is solidified into a predetermined shape, thereby producing the intended molded product. In this manner, the rubber plug 7, having the insertion holes 7*g*, the annular, endless seal element 9, the waterproof plug 9' of a generally rectangular parallelepiped shape and the grommets of a pot-shape are produced. Thereafter, if necessary, a vulcanizing treatment is applied to the molded product (such as the rubber plug 7, the seal element 9, the waterproof plug 9' and the grommet) so as to impart rubber elasticity thereto.

The support shank portions 5*c* of the male terminals 5 of the connector main portion 31 are press-fitted respectively into the insertion holes 7*g* in the thus produced rubber plug 7, and the rubber plug 7 is mounted on the connector main portion 31. Then, the proximal end portions 5*a* of the male terminals 5 of the connector main portion 31, on which the rubber plug 7 is mounted, are soldered to the circuit conductors on the printed circuit board 2, and by doing so, the connector main portion 31 is mounted on the printed circuit board 2, and at the same time electrical connection between the two is made.

The positioning pins, which enable the camera body 1' and the board body 2' to be fixed together in precisely-positioned relation to each other, are formed respectively at two diagonally-disposed ones of the four corner portions of the camera body 1' having a generally rectangular shape as seen from that side where the wires 4 are disposed. The positioning pins, formed on the camera body 1' are fitted respectively in the positioning-purpose mounting holes 2*b'* formed in the printed circuit board 2 in corresponding relation to the positioning pins, so that the camera body 1' and the board body 2' can be combined together precisely.

Then, screws are inserted respectively into the mounting holes 2*b* formed in the printed circuit board 2, and are tightened by a tool such as a screw driver, thereby fastening the camera 1 and the board 2 together. Thus, the camera module Y is assembled as shown in FIGS. 1, 2 and 5.

On the other hand, the camera casing 3, having the inner housing 32 and the connector housing 33 formed integrally therewith, the cover 10, and the connector housing 8' of the mating connector 8, having the lock arm 20 and the retaining lances formed integrally therewith, are beforehand formed by injection molding, using a polybutylene terephthalate resin (PBT) such as PBT-HO1 (grade name). If necessary, a tumbling treatment (so-called barrel polishing) may be applied to the injection molded products of the camera casing 3, the cover 10 and the connector housing 8' of the mating connector 8 so as to remove flashes from these injection molded products.

Then, as shown in FIGS. 1 and 2, the camera module Y, already assembled and prepared, is fitted into the receiving chamber 3*e* of the camera casing 3 in the mounting direction S1, and is mounted therein. At this time, the rubber plug 7 is press-fitted into the inner peripheral surface 32*c* of the inner housing 32 continuous with the connector frontage portion 30*a* formed integrally with the camera casing 3, as shown in FIG. 5, so that the restoring force is produced in the rubber plug 7, and therefore the camera casing 3 and the rubber plug 7 are positively sealingly connected together, and the connector 30, shown in FIGS. 4 and 5, is formed.

The camera module Y, shown in FIG. 2, is inserted into the camera casing 3 in the mounting direction S1, and the mounting holes 1*b*, formed respectively in the four fixing portions 1*a* of the camera 1, are generally aligned respectively with the internally-threaded screw holes 3*b* formed respectively in the four screw-fixing bodies 3*a* formed within the receiving chamber 3*e* of the camera casing 3, and then four screws (not shown) are inserted respectively into the mounting holes 1*b* formed respectively in the four fixing portions 1*a* of the camera 1. Then, the four screws are tightened and threaded by a tool such as a spanner or a screw driver. In this manner, the camera module Y is positively mounted on the camera casing 3.

If the rubber plug 7 of the camera module Y is press-fitted into the inner housing 32 of the camera casing 3 simultaneously when the camera module Y is mounted on the camera casing by tightening these fastening elements, the assembling operation can be effected more rapidly, and this is efficient in the assembling process, and therefore is preferable.

Then, the cover 10 is attached to the casing 3, such as the camera casing 3, in order to enhance the sealing performance and also to protect the accessory 1 such as the camera 1. More specifically, the mounting holes 10*b*, formed respectively in the fixing portions 10*a* formed respectively at the four corner portions of the cover 10 shown in FIG. 1, are generally aligned respectively with the mounting holes 3*b*' formed respectively in the flange-like fixing portions 3*a*' formed respectively at the four corner portions of the camera casing 3, and the attached condition, as shown in FIGS. 3 and 4, is provided.

Then, four fastening elements (not shown), such as bolts and screws, are inserted respectively into the four mounting holes 10*b* from the front side (front wall 10*c*) of the cover 10. Mating fastening elements (not shown) for these fastening elements, such as nuts of a special shape (e.g. generally fan-shaped nuts), corresponding in shape to the fastening element relief portions 3*a*" formed respectively in the four corner portions of the camera casing 3, are provided at these fastening element relief portions 3*a*", respectively. The four fastening elements, such as screws, are tightened to be threaded respectively into the mating fastening elements, such as nuts of the special shape, by a tool such as a spanner and a screw driver. In this manner, the cover 10 is secured to the camera casing 3, so that the camera module Z is assembled.

As the above four fastening elements such as bolts and screws, for example, bolts or screws, the type of fastening elements, each having a length larger than the distance between the front wall 10*c* of the cover 10 and the base plate 3*c* of the camera casing 3, may be used and fixed respectively to predetermined portions of the camera module Z shown in FIGS. 3 and 4.

If the mounting hole 3*b*, formed in each of the flange-like fixing portions 3*a*' formed respectively at the four corner portions of the camera casing 3, is an internally-threaded hole corresponding to its mating screw which is to be inserted thereinto, then the use of the mating fastening elements, such as the nuts of a special shape, is not necessary, and therefore the number of the component parts is reduced, and besides the cost is reduced, and furthermore the cover 10 can be attached to the camera casing 3 more easily and rapidly.

One example of a method of producing the female terminals, which correspond to the male terminals 5, and are mounted in the mating connector 8, will be described. First, a flat metal sheet of steel, having electrical conductivity, is blanked by a pressing machine or the like, thereby forming a metal terminal blank of a predetermined developed shape. The metal terminal blank of the predetermined developed shape, thus obtained by blanking, includes those portions which are to be formed by bending and curling respectively into a cylindrical electrical contact portion, a resilient contact piece portion, a conductor clamping and a sheath clamping piece portion of the female terminal.

Before or after the above blanking operation, the base metal sheet or the metal terminal blank may be subjected to rolling if necessary, but if this rolling is not particularly necessary, this may be omitted.

Thus, the metal terminal blank of the predetermined developed shape, obtained by the blanking operation, is prepared. Next, the predetermined portions of this metal terminal blank are subjected to bending or curling, thereby forming the female terminal having the cylindrical electrical contact portion. Thus, the female terminal of the predetermined shape is formed by blanking and bending the metal sheet.

With respect to the above blanking and bending operations, a long, continuous metal sheet (base metal sheet) is set, for example, in an inlet of a pressing machine, and is processed by the pressing machine while it is fed in a sequential manner. For example, the base metal sheet (metal sheet) is blanked into the predetermined developed shape by pressing dies (e.g. a hammer and an anvil), provided in the pressing machine, and is subjected to bending, and then is finished into the female terminal of the predetermined shape.

With respect to the sequential operations, that is, the blanking and bending operations, effected by the pressing machine, if the sequential steps of the pressing process are effected by at least one or more pressing machines of one kind, the female terminals of the predetermined shape can be produced efficiently.

For example, if the above producing method is carried out, using the type of pressing machine, in which a continuous metal sheet (base metal sheet) is set in an inlet of the pressing machine, and the processing step is effected for each stroke through a carrier portion, so that the female terminal of the predetermined shape is produced and obtained at an inlet of the pressing machine, then the female terminals of the predetermined shapes can be produced efficiently and rapidly. In the method of the production of the female terminals, the different production steps may be effected by different kinds of pressing machines so as to produce the finished female terminal of the predetermined shape.

Incidentally, such a production method for producing the female terminals can be used for producing male terminals of a predetermined shape, having, for example, a tab.

The wire harness 4 (shown in FIGS. 1 and 3) and the various parts attached thereto, as well as examples of assembling operations, will be described. The bundling tape 4*d*' is beforehand wound on the wire harness 4 in such a manner that the end portions of the cables 4*a* and drain wire 4*a*' are not covered by the tape 4*d*' over a predetermined length, and therefore the end of the wound tape 4*d*' is spaced a suitable distance from the waterproof plug 9', so that those portions of the cables 4*a* and the drain wire 4*a*', extending from the waterproof plug 9', will not be unduly bent or flexed. The grommets (not shown) are beforehand mounted on the wire harness 4.

Before or after the step of winding the bundling tape 4*d*' on the cables 4*a* and the drain wire 4*a*' to bundle them into the wire harness 4, the cables 4*a* and the drain wire 4*a*' are passed respectively through the insertion holes, formed in the waterproof plug 9' in such a manner that the cables 4*a* and the drain wire 4*a*' extend a predetermined length inwardly from the waterproof plug 9'.

The insulating sheath 4*c* (shown in FIG. 6) is removed or peeled from the end portion of each of the cables 4*a* and 4*a*', so that the conductors 4*b* are exposed from the cable 4*a*, 4*a*' over a predetermined length.

The conductors and insulating sheaths of the cables 4*a* and drain wire 4*a*' are gripped by the wire connection portions (that is, the conductor clamping piece portion and the sheath clamping piece portion) of the respective female terminals, and thus the wire connection portions of the female terminals are fixed and connected to the cables 4*a* and 4*a*', respectively. The single waterproof plug 9' of a rectangular shape may be replaced by waterproof rubber plugs of a cylindrical shape each of which is press-clamped at the region including the wire sheath clamping piece portion of the corresponding female terminal and that portion of the cable 4*a*, 4*a*' disposed adjacent to the terminal.

The female terminals, connected respectively to the cables 4*a* and 4*a*' of the wire harness 4, are inserted into the predetermined terminal receiving chambers in the connector housing 8' of the mating connector 8, and are easily and rapidly fixed by the retaining lances or the like provided in the terminal receiving chambers in the connector housing 8' of the mating connector 8. As shown in FIG. 1, the annular seal element 9 is fitted into the annular groove formed in the front end of the connector housing 8' of the mating connector 8.

The mating connector 8, thus connected to the cables 4*a* and 4*a*' of the wire harness 4, is inserted into the connector 30 formed at the camera module Z as shown in FIG. 3. By doing so, the camera module Z and the wire harness 4 are electrically connected together.

At this time, the seal element 9, provided at the front end portion of the mating connector 8, is press-fitted into the inner housing 32 of the camera casing 3, and the squeezing portion of the seal element 9 is squeezed, so that the outer peripheral surface 9*b* is held in intimate contact with the inner peripheral surface 32*c* of the inner housing 32. The front surface portion 8*a* of the connector housing 8' of the mating connector 8 is held in intimate contact with the rear surface 7*f* of the rubber plug 7 press-fitted in the inner housing 32 of the camera module Z. Thus, the mating connector 8 and the camera module Z are electrically connected together, and the connector 30 is positively sealed.

The mating connector 8 and the connector 30 of the camera module Z are positively connected together in a male-female manner, and the engagement portion 35 is provided at the connector 30 of the camera module so as to prevent the two connectors from being accidentally disconnected from each other, and the retaining portion 25, corresponding to this engagement portion, is provided at the lock arm 20 of the mating connector 8.

The retaining portion 25 and the engagement portion 35 are engaged with each other, so that the connector 30 of the camera module Z and the mating connector 8 are positively retained and engaged relative to each other. Thanks to the provision of such retaining and engaging means, the male and female connectors can be easily and rapidly coupled together, and besides the operation for disconnecting the male and female connectors through the lock arm 20 can be easily and rapidly effected, and therefore the assembling operation and disassembling operation can be effected efficiently.

Any suitable additional parts may be attached to the accessory module Z of the invention if necessary. However, depending on the region where it is used or mounted, the additional part, such for example as the cover 10, may be omitted. By doing so, there can be provided the accessory module Z in which the number of the component parts is reduced, and the compact, lightweight design is achieved, and the cost is reduced.

The accessory module Z of the invention is applied to the camera module Z as described above, and also can be applied to an accessory module used on an instrument panel of an automobile and its neighboring portion, and modules can be provided at various portions.

Among such accessory modules mounted at such various portions, the accessory module Z, provided in the form of the camera module Z comprising the camera 1 (the accessory 1) provided with the CCD mounted on the automobile, is preferred. By applying the accessory module Z of the invention to the camera module Z mounted on the automobile, the trouble, that is, the development of a cloud on the lens 1*c* of the camera 1 as a result of intrusion of moisture into the camera module Z (which has been a problem with the conventional construction), can be prevented, and the number of the peripheral parts of the camera module Z can be reduced, and the camera module Z for mounting on the automobile can have the compact, lightweight design, and therefore the cost can be reduced.

For example, the camera module of the invention is used mainly on a large-size automobile such as a passenger car and a bus, and is mounted on those portions of the automobile which can not be recognized from inside the car room during the driving, such as a dead space portion of the front portion of the automobile and that portion where a rear field of vision, disposed rearwardly of the automobile, can be obtained through the camera module, and thus the camera module is used for assisting in confirming such a dead space during the driving. In this case, this module is helpful when driving the automobile, and this is desirable.

Even when the on-vehicle CCD camera, mounted on the outer surface of an rear portion of the automobile, accidentally strikes against other object, so that the CCD camera must be inspected and repaired, the on-vehicle CCD camera of the invention can be easily disassembled, and therefore the CCD camera, which has thus become defective, can be easily disassembled and repaired, and then can be again mounted on the automobile. Therefore, preferably, the module of the invention is used as the CCD camera which is mounted on the outer surface of the rear portion of the automobile so as to secure a rear field of vision.

Therefore, as described in the above example, when a trouble, such as a failure, develops in a CCD camera, mounted on an automobile, or its peripheral portion, it need to be removed, inspected, disassembled and repaired. Even in such a case, the camera module Z of the invention can be easily mounted and removed, and therefore the maintenance performance is excellent. And besides, the camera module Z is so designed as to be disassembled easily, and therefore it can be easily re-used for recycling purposes when discarding it, and this camera module deals with the current problem of the global environment concerning industrial wastes.

As described above, according to the present invention, the accessory and the wires can be made independent of each other, and therefore the various parts to be received in the casing can be assembled in the process different from the process for the wire, and the assembling efficiency is improved. It is not necessary to effect the cumbersome assembling operation as in the prior art technique, and the rapid assembling operation of the accessory module can be carried out. In contrast with the prior art technique, the accessory module is assembled, using the connector main portion having the terminals, and therefore the connector can be easily formed at the accessory module during the assembling operation. Therefore, the assembling operation of the accessory module can be automated.

With the use of the sealing structure of the accessory module of the invention, the accessory, the connector main portion, formed by the terminals and the connector board, and the board, having the first sealing member mounted on this connector main portion, are mounted on the casing, and by doing so, the connector is formed at the accessory module. Therefore, when removing the wire from the accessory module, the accessory module can be separated from the wire without the need for disassembling the accessory module, and there can be provided the accessory module which is excellent in maintenance performance such as the handling.

In connection with the fact that the accessory module can be easily assembled, the accessory module can be easily disassembled, and therefore this structure is suited for recycling. Therefore, this contributes to the reduction of industrial wastes concerning the current problem of the global environment.

And besides, a defective product, which might be produced when assembling the conventional accessory module can be eliminated. In the conventional construction, the wires were, in some cases, caught between the board and the casing when mounting the board, having the accessory mounted thereon, on the casing, and in such an accessory module, there was a fear that the inner portion of the wire was cut, and therefore it must be treated as a defective product.

However, it is not desirable to discard such semi-finished products from the viewpoint of the global environment, and besides this is wasteful from the viewpoint of production, and therefore it was necessary to re-assemble the accessory module while changing the wire and those parts relevant to the wire. However, by adopting the present invention, such defective products can be eliminated without the need for much time and labor.

Furthermore, the first sealing member, which maintains the sealed condition of the interior of the casing, is provided in the inner housing of the casing, and therefore foreign matters, such as moisture, dust and dirt, will not intrude into the interior of the casing from the exterior through the connector frontage portion, so that a trouble can be prevented from developing in the accessory module.

In the conventional accessory module, the interiors of the connectors were not sealed, and therefore when moisture or the like intruded into the interiors of the connectors, the moisture intruded to the board via the connectors, and there was a fear that this adversely affected the accessory module. However, by the use of the sealing structure of the accessory module of the invention, foreign matters, such as moisture, dust and dirt, will not intrude into the interior of the accessory module through the connector formed at the accessory module, and therefore any trouble will not develop in the accessory module, and the stable operation of the accessory module can be maintained for a long period of time.

It is not necessary to provide the complicated sealing structure in order to enhance the sealing performance, and therefore the number of the component parts will not increase, and there can be provided the accessory module having the simplified assembling structure, and besides the sealed condition of the interior of the casing can be kept good. Therefore, the cost of the accessory module is reduced, and besides the sealing operation of the accessory module can be carried out easily and rapidly.

The accessory module of the invention can be easily assembled in the assembling process, and can be easily disassembled. Therefore, for example, even when the first sealing member, provided in the inner housing within the receiving chamber of the casing, is subjected to aged deterioration, and hence need to be exchanged, the disassembling, repairing, exchanging and assembling operations can be rapidly carried out so as to apply a suitable treatment to the defective portion.

The accessory is sealed by the casing and the first sealing member, and therefore depending on the installation environment, the mating connector, mounted on the wire, can be of the non-waterproof type, and a general-purpose connector of the standard type can be used as the mating connector adapted to be connected to the accessory module. And besides, the control man-hour and the cost can be reduced by providing the parts for common use or the common parts.

In the present invention, when mounting the first sealing member rubber on the connector main portion formed by the terminals and the connector board, the terminals, provided at the connector main portion, are aligned respectively with the insertion holes in the sealing member, and are press-fitted respectively into these insertion holes in the sealing member, and the first sealing member is pressed against the connector board of the connector main portion, and as a result each of the terminals can be easily and positively sealed at that portion thereof extending from the point (from which the terminal projects outwardly from the first sealing member) to the connector board.

In the present invention, merely by connecting the mating connector, secured to the wire, to the connector provided at the casing, the connector is sealed, and therefore the connector does not need to have a complicated, special sealing structure. Therefore, there can be provided the accessory module in which the number of the component parts is not increased, and the cost is reduced, and the excellent sealing performance is achieved. And besides, the fitting connection between the connector of the casing and the mating connector, secured to the wire, can be easily and rapidly effected and canceled. There can be provided the accessory module in which the connectors, which can be coupled together in a male-female manner, can be easily electrically connected together and disconnected from each other.

In the present invention, at least one lip, comprising at least one ridge, is formed on at least one surface of the first sealing member, the lip enhancing the sealing performance of this surface. Therefore, the lip is pressed against the mating member, and is squeezed to produce a restoring force, thereby forming a positive seal between the first sealing member and the mating member.

In the present invention, the accessory is positively sealed by the casing and the cover, and therefore foreign matters, such as moisture, dirt and dust, will not intrude into the interior of the accessory module from the exterior, and a trouble can be positively prevented from developing the accessory module.

In the present invention, the accessory module is applied to the camera module for mounting on an automobile, and therefore the trouble, that is, the development of a cloud on the lens as a result of intrusion of moisture into the camera module can be prevented.

What is claimed is:

1. A sealing structure of an accessory module comprising:

an accessory mounted on a circuit board; and a connector main portion defined by terminals and a connector board, one end portions of said terminals are soldered to said circuit board;

a first sealing member provided at said connector main portion;

an inner housing corresponding to said connector main portion, formed within a receiving chamber of a casing; and a connector frontage portion formed at said casing, wherein said accessory, said circuit board, said connector main portion and said first sealing member make up an accessory module and wherein said accessory module is inserted into said receiving chamber of said casing, such that said first sealing member is held in intimate contact with said inner housing to seal said connector frontage portion so as to form a connector, and said circuit board is received within said receiving chamber.

2. A sealing structure of an accessory module according to claim 1, wherein the other end portion of said terminals project toward an opening of said connector frontage portion, and insertion holes, corresponding respectively to said terminals, are formed through said first sealing member, and said terminals are press-fitted into said insertion holes, corresponding respectively to said terminals, are formed through said first sealing member, and said terminals are press-fitted into said insertion holes, respectively, so that said first sealing member is held in intimate contact with said connector board.

3. A sealing structure of an accessory module according to claim 1, further comprising:

a second sealing member provided at a front portion of a mating connector secured to a cable, and when said mating connector and said connector are coupled together, the two are electrically connected together, and a front surface portion of said mating connector is held in intimate contact with said first sealing member provided at said connector, and said second sealing member, provided at said mating connector, is held in intimate contact with said inner housing of said casing to seal said connector.

4. A sealing structure of an accessory module according to claim 1, wherein at least one lip, is formed on at least one surface of said first sealing member, said lip enhancing a sealing performance of said surface.

5. A sealing structure of an accessory module according to claim 1, wherein when a cover is attached to said casing, a mating surface of said casing and a mating surface of said cover are abutted against each other, so that said accessory is sealed within said receiving chamber of said casing or a receiving chamber of said cover.

6. A sealing structure of an accessory module according to claim 1, wherein said accessory is a camera module which is equipped by a camera adapted to be mounted on an automobile.

7. A sealing structure of an accessory module comprising:

an accessory mounted on a circuit board; and a connector main portion defined by terminals and a connector board, one end portion of said terminals are soldered to said circuit board;

a first sealing member provided at said connector main portion;

an inner housing corresponding to said connector main portion, formed within a receiving chamber of a casing;

a connector frontage portion formed at said casing, wherein when said board is mounted on said casing, said first sealing member is held in intimate contact with said inner housing to seal said connector frontage portion so as to form a connector, and a second sealing member provided at a front portion of a mating connector secured to a cable, and when said mating connector and said connector are coupled together, the two are electrically connected together, and a front surface portion of said mating connector is held in intimate contact with said first sealing member provided at said connector, and said second sealing member, provided at said mating connector, is held intimate contact with said inner housing of said casing to seal said connector.

* * * * *